US007113727B2

(12) United States Patent
Kosuge et al.

(10) Patent No.: US 7,113,727 B2
(45) Date of Patent: Sep. 26, 2006

(54) CHARGING DEVICE USING A CHARGE ROLLER AND IMAGE FORMING APPARATUS INCLUDING THE SAME

(75) Inventors: Akio Kosuge, Kanagawa (JP); Toshio Koike, Kanagawa (JP); Yutaka Narita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/252,808

(22) Filed: Oct. 19, 2005

(65) Prior Publication Data

US 2006/0034636 A1 Feb. 16, 2006

Related U.S. Application Data

(62) Division of application No. 11/147,433, filed on Jun. 8, 2005, now Pat. No. 6,990,305, which is a division of application No. 10/661,569, filed on Sep. 15, 2003, now Pat. No. 6,961,529.

(30) Foreign Application Priority Data

| | | |
|---|---|---|
| Sep. 13, 2002 | (JP) | 2002-267795 |
| Oct. 24, 2002 | (JP) | 2002-309554 |
| Dec. 17, 2002 | (JP) | 2002-365346 |
| Dec. 17, 2002 | (JP) | 2002-365361 |

(51) Int. Cl.
*G03G 15/02* (2006.01)

(52) U.S. Cl. ..... 399/176; 361/221; 492/18; 492/39

(58) Field of Classification Search ..... 399/176, 399/174, 175, 168, 303, 313, 115, 265, 267, 399/279; 361/221; 430/902; 29/895; 492/18, 492/25, 39
See application file for complete search history.

(56) References Cited

U.S. PATENT DOCUMENTS

| | | | | |
|---|---|---|---|---|
| 2001/0012460 | A1 | 8/2001 | Sato et al. | 399/176 |
| 2001/0017995 | A1 | 8/2001 | Sato et al. | 399/176 |
| 2002/0051654 | A1 | 5/2002 | Niimi et al. | 399/159 |
| 2002/0110387 | A1 | 8/2002 | Fujishiro | 399/159 |
| 2003/0072587 | A1 | 4/2003 | Sugiura et al. | 399/176 |
| 2003/0175046 | A1 | 9/2003 | Namiki et al. | 399/176 |

FOREIGN PATENT DOCUMENTS

| | | | |
|---|---|---|---|
| JP | 05-100585 A | * | 4/1993 |
| JP | 07-209959 A | | 8/1995 |
| JP | 11-095532 A | * | 4/1999 |
| JP | 2001-194868 | | 7/2001 |
| JP | 2001-337515 | | 12/2001 |
| JP | 2002-55508 | | 2/2002 |
| JP | 2003-076117 A | * | 3/2003 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus of the present invention includes a charging device including a charge roller formed with annular grooves at opposite end portions thereof and configured to charge an image carrier. Annular gap forming members each are fitted in the annular grooves for forming a gap between the charge roller and the image carrier. The gap forming members each have an area of $1.0\times10^{-6}$ m$^2$ to $3.0\times10^{-6}$ m$^2$ in a section containing the axis of the charge roller.

8 Claims, 26 Drawing Sheets

CHARGING DEVICE USING A CHARGE ROLLER AND IMAGE FORMING APPARATUS INCLUDING THE SAME

CROSS REFERENCE TO RELATED APPLICATIONS

This application is a divisional of and claims priority under 35 U.S.C. §120 to U.S. application Ser. No. 11/147,433, filed Jun. 8, 2005, now U.S. Pat. No. 6,990,305, which is a divisional of U.S. application Ser. No. 10/661,569, filed Sep. 15, 2003, now U.S. Pat. No. 6,961,529, and is also based upon and claims priority under 35 U.S.C. §119 from Japanese Application Nos. 2002-267795, filed Sep. 13, 2002; 2002-309554, filed Oct. 24, 2002; 2002-365346, filed Dec. 17, 2002; and 2002-365361, filed Dec. 17, 2002, the entire contents of each of which are incorporated herein by reference.

BACKGROUND OF THE INVENTION

1. Field of the Invention

The present invention relates to a charging device for charging a photoconductive drum or similar image carrier with a charge roller and a copier, facsimile apparatus, printer or similar image forming apparatus including the same.

2. Description of the Background Art

Generally, an image forming apparatus includes a charging device for charging a photoconductive drum or similar image carrier during an image forming process. While a scorotron charger, corotron charger or similar non-contact type of charging device that does not contact the image carrier has been commonly used, a contact type of charging device is attracting increasing attention because the non-contact type of charging device produces a large amount of undesirable discharge products including ozone. Among some different contact type of charging devices available today, a charging device having a charge roller pressed against the image carrier is extensively used. Japanese Patent Laid-Open Publication No. 2001-337515, for example, proposes a charge roller whose surface is implemented by rubber or resin.

However, a charging device using a charge roller has a problem that toner and impurities accumulate on the surface of the charge roller little by little and make charging irregular, thereby reducing the life of the charging device. To solve this problem, Japanese Patent Laid-Open Publication No. 2001-194868, for example, discloses a charging device in which films, adhered to opposite end portions of a charge roller over the entire circumference, contact an image carrier to thereby form a preselected gap between the center portion of the charge roller and the image carrier. In this configuration, the center portion of the charge roller does not contact the image forming range of the image carrier and is therefore free from the accumulation of smears, so that the life of the charging device is prevented from being reduced. The films, however, start peeling at seams in the circumferential direction of the charge roller due to repeated contact of the charge roller and image carrier.

In light of the above, Japanese Patent Laid-Open Publication No. 2002-55508, for example, teaches a charging device in which elastic, seamless, annular tubes are fitted in annular grooves formed in opposite end portions of a charge roller. The tubes contact an image carrier and form a preselected gap between the center portion of the charge roller and the image carrier, thereby solving the problem particular to the films.

Although tubes or similar annular members are generally thicker and therefore more durable than films, the thickness deviation of each tube in the circumferential direction increases. Therefore, in the charging device using annular tubes, the gap between the center portion of the charge roller and the image carrier is apt to vary due to the thickness deviation to such a degree that the center portion of the charge roller contacts the image carrier. This is particularly true when the photoconductive drum or the body of the charge roller is machined because machining is apt to make the diameter of the drum or that of the roller body larger at the center portion than at the end portions. Further, the drum and charge roller are more likely to contact each other if they are eccentric or nor parallel to each other. Although the charge roller may be machined after the tubes have been fitted thereon, such a procedure is not only time-consuming but also liable to cause the tubes to turn during machining, resulting an increase in cost.

Another problem with the tube scheme is that when the tubes, which are thermally shrinkable and simply fitted in the annular grooves of the charge roller, lose elasticity due to aging, the edges of the tubes get on the circumferential surface of the charge roller and are damaged or increase the gap to thereby bring about abnormal discharge.

Discharge from the charge roller toward the image carrier occurs in the end portions of the charge roller outside of the tubes or similar annular members in the same manner as in the center portion. This causes the image carrier to locally wear little by little and thereby causes a charge bias to leak. In addition, it is likely that toner deposits on the charge roller due to defective cleaning and increases the gap to thereby bring about abnormal discharge.

Laid-Open Publication No. 2001-337515 mentioned earlier shows in FIGS. 10 and 11 a configuration in which the diameter of the charge roller is smaller in the opposite end portions outside of gap forming members in the axial direction than at the center portion. However, this configuration is not directed toward the prevention of discharge in the portions outside of the image forming range, but directed toward easy fitting of the above members that are several millimeters thick and elastic.

SUMMARY OF THE INVENTION

It is an object of the present invention to provide a discharging device capable of forming an accurate gap between a charge roller or charging member and an image carrier and an image forming apparatus including the same.

It is another object of the present invention to provide a charging device capable of protecting gap forming members from deterioration while enhancing durability thereof and an image forming apparatus including the same.

It is still another object of the present invention to provide a charging device capable of preventing gap forming members from getting on steps formed in opposite end portions of a charge roller and obviating discharge in the opposite end portions outside of the image forming members and an image forming apparatus including the same.

It is yet another object of the present invention to provide a charging device capable of preventing smears from accumulating on a charge roller without regard to the thickness deviation pattern of gap forming members and an image forming apparatus including the same.

It is a further object of the present invention to provide a low cost, highly durable charging device and an image forming apparatus including the same.

An image forming apparatus of the present invention includes a charging device including a charge roller formed with annular grooves at opposite end portions thereof and configured to charge an image carrier. Annular gap forming members each are fitted in the annular grooves for forming a gap between the charge roller and the image carrier. The gap forming members each have an area of $1.0\times10^{-6}$ $m^2$ to $3.0\times10^{-6}$ $m^2$ in a section containing the axis of the charge roller.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the image forming apparatus in accordance with the present invention will be described hereinafter.

First Embodiment

Figure 1:
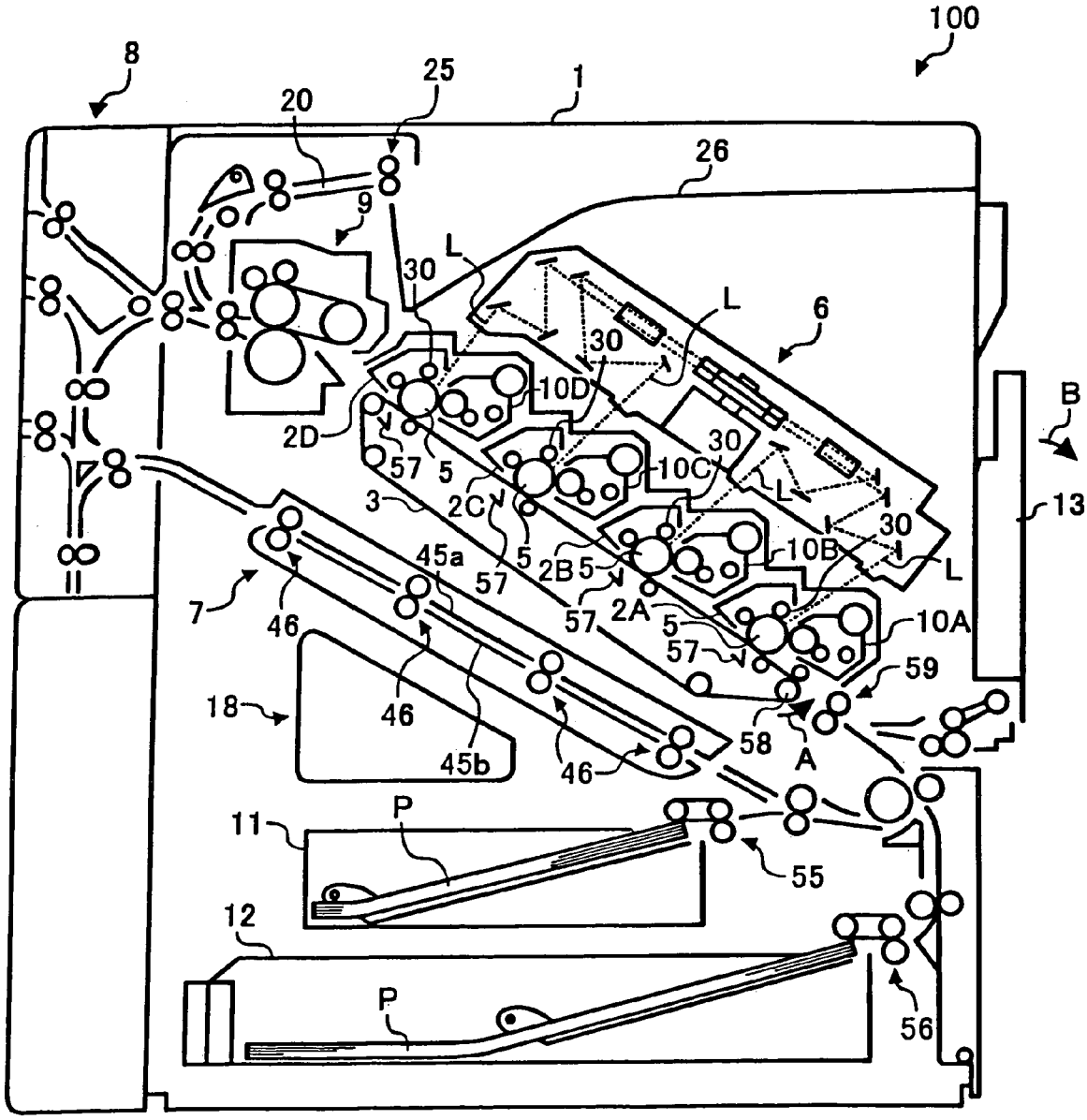
FIG. 1 is a side elevation showing a first embodiment of the image forming apparatus in accordance with the present invention.

Referring to FIG. 1 of the drawings, an image forming apparatus embodying the present invention is shown and implemented as a tandem full-color printer by way of example. The full-color printer may, of course, be replaced with a monochromatic printer or any one of a copier, a facsimile apparatus and other conventional image forming apparatus. As shown, the printer, generally 100, includes a printer body 1 accommodating four removable drum units or image carrier units 2A, 2B, 2C and 2D. An image transferring unit is located at substantially the center of the printer body 1 and includes an image transfer belt 3 passed over a plurality of rollers including an adhesion roller 58. The image transfer belt (simply belt hereinafter) 3 is movable in a direction indicated by an arrow A in FIG. 1. Four image transfer brushes 57 are disposed in the loop of the belt 3 and respectively face four drums 5, which are accommodated in the drum units 2A through 2D.

In the illustrative embodiment, the printer is capable of fixing a toner image on a sheet-like recording medium, i.e., any one of a plain paper customary with, e.g., a copier, an OHP (OverHead Projector) film, a card, postcard or similar 90K sheet, and a thick sheet, envelope or similar special sheet having weight of about 100 $g/m^2$ or above and larger in thermal capacity than a plain paper. The recording medium may be of A4, A3 or similar regular size or of irregular size, as desired.

The drums 5 are held in contact with the upper run of the belt 3. Four charging devices 30 are disposed in the four drum units 2A through 2D in association with the drums 5. Developing devices 10A through 10D, each storing toner of a particular color, are associated with the drum units 2A through 2D, respectively. In the illustrative embodiment, the developing devices 10A through 10D, which are identical in configuration with each other, each use a two-component type developer, i.e., a toner and carrier mixture. More specifically, the developing devices 10A through 10D respectively use magenta toner, cyan toner, yellow toner, and black toner.

The developing devices 10A through 10D each include a developing roller facing the drum 5 associated therewith, a screw conveyor for conveying the developer while agitating it, and a toner content sensor, although not shown specifically. The developing roller is made up of a rotatable sleeve and a stationary magnet roller disposed in the sleeve. A toner replenishing device, not shown, replenishes fresh toner to the developing device in accordance with the output of the toner content sensor.

The toner contains binder resin, a colorant and a charge control agent as major components and may include additives as well, if necessary. The binding resin may be implemented by, e.g., polystyrene, styrene-acrylic ester copolymer or polyester resin. The colorant may be implemented by any one of conventional colorants. The content of the colorant should preferably be 0.1 pts. wt to 15 pts. wt. for 100 pts. wt. of binder resin.

As for the charge control agent, Nigrosine, a chromium-containing complex, a quarternary ammonium salt or the like may be selectively used accordance with the polarity of toner grains. The content of the charge control agent is 0.1 pts. wt. to 10 pts. wt. for 100 pts. wt. of binder resin. A fluidity imparting agent may advantageously be added to toner grains.

The fluidity imparting agent may be any one of fine grains of silica, titania, alumina or similar metal oxide, such fine grains whose surfaces are treated by a silane coupling agent, a titanate coupling agent or the like, and fine grains polystyrene, polymethyl methacrylate, polyvinylidene fluoride or similar polymer. The fluidity imparting agent should preferably have a grain size of 0.01 μm 0.3 μm. The content of the fluidity imparting agent should preferably be 0.1 pts. wt. to 0.7 pts. wt. for 100 pts. wt. of toner grains.

The toner for the two-component type developer may be produced by any one of or a combination of conventional methods. For example, in the kneading and pulverizing method, the binder resin, carbon black or similar colorant and necessary additives are dry-mixed, heated, melted and kneaded by an extruder, double-roll or a triple-role, cooled, solidified, pulverized by a jet mill or similar pulverizer, and then classified by a pneumatic classifier. Alternatively, the toner may be directly produced from a monomer, a colorant and additives by suspended polymerization or non-aqueous dispersion polymerization.

Carrier grains generally consist only of a core material itself or of the core material provided with a coating layer. Ferrite and magnetite may be used as the core material of the resin-coated carrier grains. The particle size of the core material should preferably be 20 μm to 60 μm. The material for forming the carrier coating layer may be any one of vinylidene fluoride, tetrafluoroethylene, hexafluoropropylene, perfluoroalkyl vinylether, vinyl ether with fluorine atoms substituted, and vinyl ketone with fluorine atoms substituted. The coating layer may be formed by spraying the resin on the surfaces of the grains of the core material or by dipping the grains in the resin as conventional.

A writing unit 6 is positioned above the drum units 2A through 2D while a duplex print unit 7 is positioned below the belt 3. A waste toner tank 18 is located below the duplex print unit 7. A sheet reversing unit 8 is mounted to the left side of the printer body, as viewed in FIG. 1, and configured to selectively reverse and then discharge a sheet or recording medium P or steer it toward the duplex print unit 7.

The writing unit 6 includes four LDs (Laser Diodes) each being assigned to a particular color, a polygon scanner including a polygonal mirror having six faces and a polygon motor, fθ lenses, elongate WTL lenses, and mirrors. Laser beams L, issuing from the LDs, each are steered by the polygon scanner to scan a particular drum 5.

The duplex print unit 7 includes a pair of guide plates 45*a* and 45*b* and a plurality of (four in the illustrative embodiment) roller pairs 46 for conveyance. In a duplex print mode for forming images on both surfaces of the sheet P, the sheet P, carrying an image on one surface thereof and switched back via the sheet reversing unit 8, is introduced into the duplex print unit 7 and again fed therefrom.

The sheet reversing unit 8 includes a plurality of roller pairs for conveyance and a plurality of pairs of guide plates. The sheet reversing unit 8 selectively reverses the sheet P and then conveys it toward the duplex print unit 7 in the duplex print mode or directly discharges the sheet P, which carries an image thereon, to the outside of the printer body 1 or discharges it after reversing it.

A fixing unit 9 is positioned between the belt 3 and the sheet reversing unit 8 for fixing an image carried on the sheet P. A reverse discharge path 20 branches off the downstream side of the fixing unit 9 in the direction of sheet conveyance, so that the sheet P introduced into the path 20 is driven out to a print tray 26 by an outlet roller pair 25.

A sheet feeding section is arranged in the lower portion of the printer body 1 and includes sheet cassettes 11 and 12 and pickup sections 55 and 56 assigned to the sheet cassettes 11 and 12, respectively. The sheet cassettes 11 and 12 each are loaded with a stack of sheets of particular size. A manual sheet feed tray 13 is mounted on the right side of the printer body 1, as viewed in FIG. 1, and openable in a direction indicated by an arrow B. By opening the manual sheet feed tray 13, the operator of the printer may feed sheets by hand.

The drum units 2A through 2D, identical in configuration with each other, respectively form a magenta toner image, a cyan toner image, a yellow toner image, and a black toner image.

The operation of the printer 100 will be described hereinafter. First, in a full-color mode, the drums 5 are rotated clockwise, as viewed in FIG. 1, while the charging devices 30 uniformly charge the surfaces of the drums 5 associated therewith. Laser beams L, issuing from the writing unit 6 and respectively modulated in accordance with magenta image data, cyan image data, yellow image data and black image data, scan the charged surfaces of the drums 5 of the drum units 2A through 2D, respectively. As a result, latent images are formed on the surfaces of the drums 5. When the latent images are conveyed to the developing devices 10A through 10D by the drums 5, the developing devices 10A through 10D respectively develop the latent images with magenta toner, cyan toner, yellow toner and black toner, thereby producing toner images of different colors.

The sheet P is fed from either one of the sheet cassettes 11 and 12 by the pickup section 55 or 56 associated therewith to a registration roller pair 59, which is positioned just before the belt 3. The registration roller pair 59 stops the sheet P and then starts driving it at such timing that the leading edge of the sheet P meets the leading edges of the toner images formed on the consecutive drums 5. The adhesion roller 58, adjoining the inlet of the belt 3, charges the sheet P to positive polarity for thereby causing it to electrostatically adhere to the belt 3. While the sheet P is being conveyed by the belt 3 in such a condition, the magenta, cyan, yellow and black toner images are sequentially transferred from the drums 5 to the sheet P one above the other, completing a full-color or four-color image thereon.

Subsequently, the fixing unit 9 fixes the full-color image on the sheet P with heat and pressure. The sheet P is then routed through a particular path in accordance with the mode selected by the operator. More specifically, the sheet P is reversed and then driven out to the print tray 26 or directly discharged from the fixing unit 9 via the sheet reversing unit 8. Further, in the duplex mode, the sheet P, carrying an image on one surface thereof, is reversed by the sheet reversing unit 8, switched back into the duplex print unit 7, again fed to the image forming stations where the drum units 2A through 2D are positioned, and then driven out as a duplex print. Such an image forming process will be repeated when two or more duplex prints are desired.

In a black-and-white mode as distinguished from the full-color mode, a driven roller, which is one of rollers supporting the belt 3, is lowered to release the belt 3 from the magenta, cyan and yellow drums 5. Thereafter, the black drum 5 of the drum unit 2D is rotated clockwise and uniformly charged by the charging device 30 associated therewith. The laser beam L, modulated in accordance with black image data, scans the charged surface of the black drum 5 to thereby form a latent image. Subsequently, the developing device 10D develops the latent image with black toner, thereby producing a black toner image. In this mode operation, the other image forming stations are not operated in order to avoid unnecessary fatigue.

When the sheet P is fed from the sheet cassette 11 or 12 to the drum unit 2D via the registration roller pair 59 and adhesion roller 58 in the same manner as in the full-color mode, the black toner image is transferred from the black drum 5 to the sheet P. Subsequently, the sheet P has the black toner image fixed thereon by the fixing unit 9 and is then routed through a particular path in accordance with the mode selected. The above procedure will be repeated when two or more black-and-white prints are desired.

To stably convey the sheet P under electrostatic adhesion, the belt 3 should have at least a surface layer thereof formed of a high resistance material. The belt 3 may be implemented as a seamless belt produced by molding polyvinylidene fluoride, polyimide, polycarbonate, polyethylene terephthalate or similar resin. If desired, carbon black or similar conductive material may be added to such resin in order to control resistance. Further, the belt 3 may be provided with a laminate structure made up of a base layer formed of the above resin and a surface layer formed on the base layer by, e.g., spray coating or dip coating.

Figure 2:
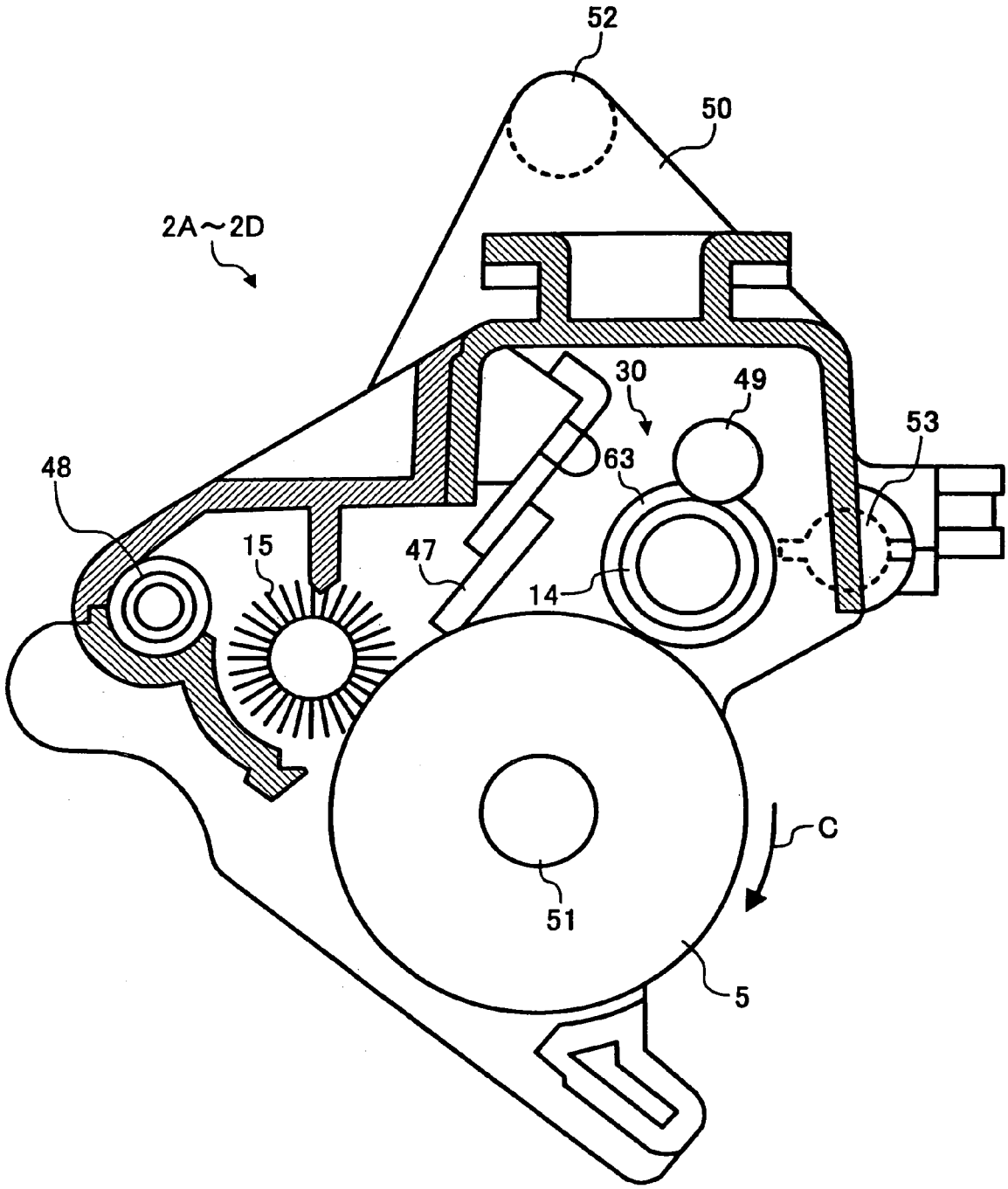
FIG. 2 is a side elevation showing a drum unit included in the first embodiment.

As shown in FIG. 2, the drum units 2A through 2D each include, in addition to the drum 5 and charging device 30, a brush roller 15 and a cleaning blade 47 for cleaning the surface of the drum 5. The charging device 30 is made up of a charge roller 14 and a gap forming member 63 fitted on the charge roller 14. A cleaning roller 49 is held in contact with the charge roller 14 and gap forming member 63 for cleaning the surface of the charge roller 14.

The brush roller 15 moves toner scraped off from the drum 5 by the cleaning blade 47 toward an auger 48. The auger 48 in rotation conveys the toner to the waste toner tank 18, FIG. 1. In the illustrative embodiment, the drum 5 is provided with a diameter of 30 mm and caused to rotate at a speed of 125 mm/sec in a direction indicated by an arrow C in FIG. 2.

The drum units 2A through 2D each include a main reference portion 51 for positioning and a front and a rear subreference portion 52 and 53 for positioning. The subreference portions 52 and 53 are formed integrally with a single bracket 50. With this configuration, the drum unit can be accurately positioned relative to the printer body 1 when mounted to the printer body 1.

The drum 5 and charging device 30 are mounted on a single drum unit and therefore positioned relative to each other within the drum unit. When the entire drum unit is replaced, the charging device 30 and drum 5 are removed from the printer body 1 integrally with each other. This allows even the user of the printer 100 to easily replace the drum unit without any gap adjustment. While the drum 5, charging device 30 and brush roller 15, cleaning blade 47 and cleaning roller 49 are shown as being constructed into a unit, the cleaning members 15, 47 and 49 may be mounted on an exclusive unit. Further, the developing device 10, drum 5 and charging device 30 may be constructed into a single unit.

The drum 5 is made up of a conductive core, an under layer formed on the core, and a charge generating layer and a charge transport layer sequentially formed on the under layer. The charge generating layer and charge transport layer are mainly formed of a charge generating substance and a charge transport substance, respectively. The conductive core may be implemented as, e.g., a pipe formed of aluminum, stainless steel or similar metal or an endless belt formed of nickel so long as it has volumetric resistance of $10^4$ Ω·cm or below.

While the undercoat layer generally contains resins as its major component, the resins should preferably have high solution resistance against general organic solvents when consideration is given to the fact that a photoconductive layer is formed on the undercoat layer by use of a solvent. Resins of this kind include water-soluble resin, e.g., polyvinyl alcohol resin, alcohol-soluble resin, e.g., copolymerized nylon, and curing type of resin forming a three-dimensional network, e.g., polyurethane resin, alkyd-melamine resin or epoxy resin. Fine powder of metal oxides, e.g., titanium oxide, silica and alumina may be added to the undercoat layer for obviating moiré and reducing residual potential. The undercoat layer may be formed by use of a suitable solvent and a suitable coating method. The thickness of the undercoat layer should preferably be 0 μm to 5 μm.

The charge generating layer contains a charge generating material as a major component. Typical of the charge generating material are monoazo pigment, disazo pigment, trisazo pigment, and phthalocyanine-based pigment. The charge generating layer may be formed by dispersing the charge generating material together with the binder resin, e.g., polycarbonate into a solvent, e.g., tetrahydrofuran or cyclohexanone to thereby prepare a dispersion solution, and then coating the solution by dipping or spraying. The thickness of the charge generating layer is usually 0.01 μm to 5 μm.

The charge transport layer may be formed by dissolving or dispersing the charge transport material and binder resin into a suitable solvent, e.g., tetrahydrofuran, toluene or dicycloethane, and coating and then drying the resulting mixture. Among the charge transport materials, the charge transport materials of low molecular weight include an electron transport material and a hole transport material. The electron transport material may be implemented by an electron receiving material, e.g., chloranil, bromanil, tetracyanoethylene, tetracyanoquinodimethane, 2,4,7-trinitro-9-fluorenone, 2,4,5,7-tetranitro-9-fluorenone, or 1,3,7-trinitrodibenzothiophene-5,5-dioxide. The hole transport material may be implemented by an electron donative material, e.g., oxazole derivatives, oxadiazole derivatives, imidazloe derivatives, triphenylamine derivatives, phenyl hydrazones, α-phenylstilbene derivatives, thiazole derivatives, triazole derivatives, phenazine derivatives, acridine derivatives or thiophene derivatives.

The binder resin used for the charge transport layer together with the charge transport material may be any one of a thermoplastic or thermosetting resin, e.g., polystyrene resin, styrene-acrylonitrile copolymer, styrene-butadiene copolymer, polyester resin, polyallylate resin, polycarbonate resin, acryl resin or epoxy resin, melamine resin and phenol resin. The thickness of the charge transport layer may advantageously be selected within the range of 5 μm 30 μm in accordance with the desired characteristics of the photoconductor. A protection layer may be formed on the drum 5 as a surface layer for protecting the photoconductive layer and enhancing the durability of the layer.

Figure 3:
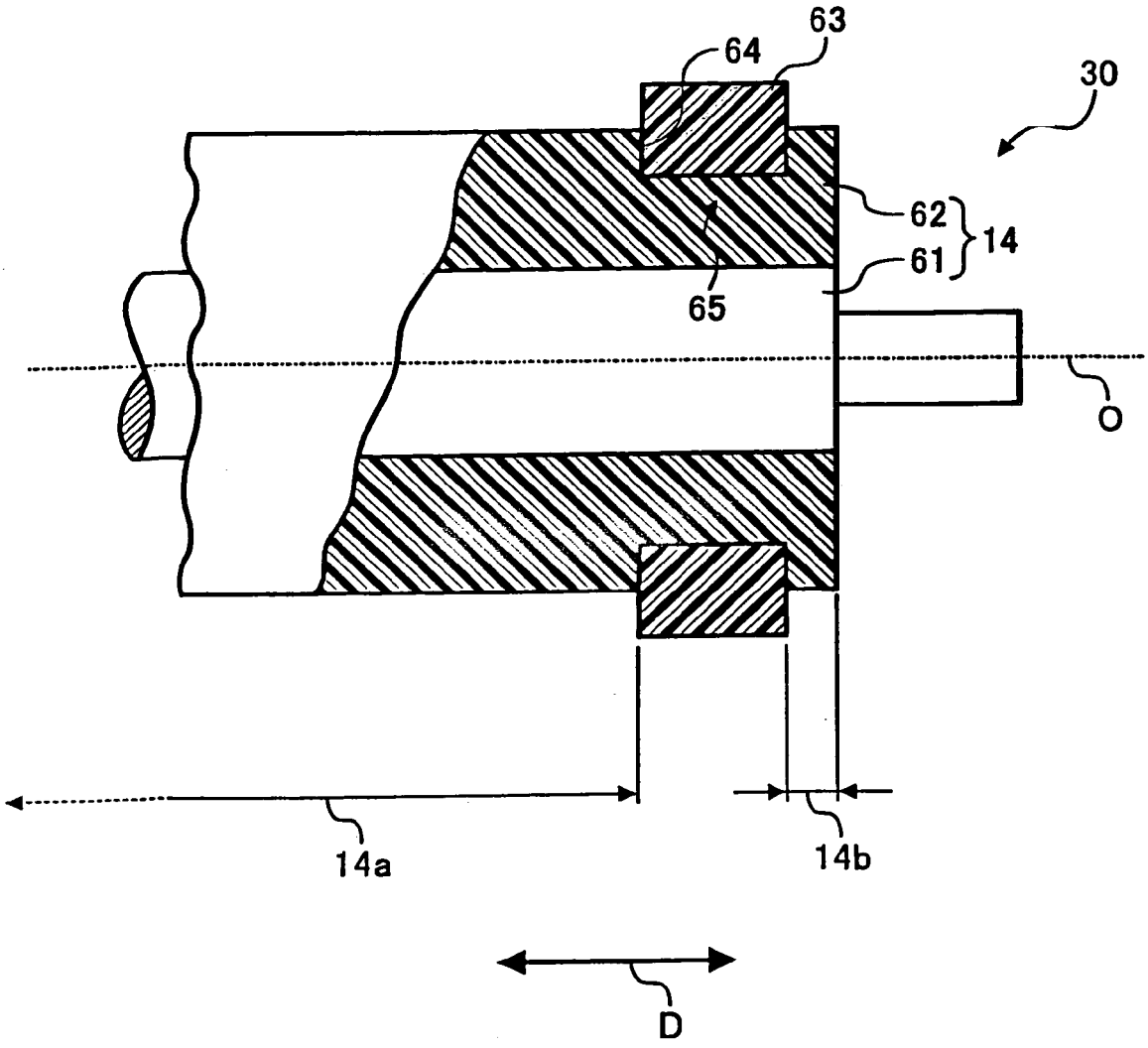
FIG. 3 is a section showing one end portion of a charging device included in the first embodiment.

FIG. 3 is a fragmentary section showing the configuration of the charge roller 14 and gap forming member 63. While FIG. 3 shows only one end portion of the charge roller 14, another gap forming member identical with the gap forming member 63 is fitted on the other end portion of the charge roller 14. As shown, the charge roller 14 is made up of a metallic core or conductive support 61 and a resin layer or charging member 62. The gap forming member 63, which is annular, is fitted in an annular groove 65 formed in the resin layer 62 and implemented by a stepped portion 64. In this condition, the gap forming member 63 forms a gap between the charge roller 14 and the drum 5 in cooperation with the other gap forming member.

The metallic core 61 is formed of stainless steel or similar metal. If the diameter of the metallic core 61 is excessively small, then the deformation of the core 61 is not negligible when machined or pressed against the drum 5, making it difficult to provide the gap with necessary accuracy. On the other hand, if the above diameter is excessively large, then the charge roller 14 becomes bulky or heavy. In light of this, the diameter of the core 61 should preferably be between 6 mm and 10 mm.

The resin layer 62 should preferably be formed of a material whose volumetric resistance is between $10^6$ ΩAcm and $10^9$ ΩAcm. Excessively low resistance is apt to cause the charge bias to leak when, e.g., pin holes or similar defects exist in the drum 5 while excessively high resistance prevents uniform charge potential from being established due to short discharge. The desired volumetric resistance is attainable if a conductive material is added to the resin layer or base resin 62.

As for the base resin, there may be used any one of polyethylene, polypropylene, polymethyl methacrylate, polystyrene, ABS (acrylonitrile-butadiene-styrene copolymer) and polycarbonate by way of example. Such resins are easily to mold.

As for the conductive material, use may advantageously be made of an ion-conductive substance, e.g., a high polymer containing a quaternary ammonium base. Examples of polyolefine having a quaternary ammonium base are polyethylene, polypropylene, polybutene, polyisoprene, ethylene-ethylacrylate copolymer, ethylene-methacrylate copolymer, ethylene-vinyl acetate copolymer, ethylene-propylene copolymer, and ethylene-hexene copolymer each having a quaternary ammonium base. While in the illustrative embodiment use is made of polyolefines having quaternary ammonium bases, high polymers other than the polyolefines having quaternary ammonium bases may, of course, be used so long as they do not deviate from the objects of the present invention.

The ion-conductive material mentioned above can be uniformly distributed in the base resin if use is made of a biaxial kneader, kneader or similar kneading means. The base resin with the ion-conductive material can be easily molded into a roller by injection molding or extrusion molding. The content of the ion-conductive material should preferably be 30 pts. wt. to 80 pts. wt. for 100 pts. wt. of base resin.

The resin layer 62 should preferably be 1 mm to 3 mm thick. The resin layer 62 is difficult to mold and insufficient in strength if extremely thin or renders the charge roller 14 bulky and increase the actual resistance of the resin layer 62, i.e., lowers charging efficiency if excessively thick. If desired, a several micrometers thick protection layer, which allows a minimum of toner to deposit thereon, may be formed on the resin layer 62 by coating or similar technology.

At the time when the resin layer 62 is machined to adjust the outside diameter, the stepped portion 64 is formed in the end portion of the resin layer 62, so that the gap forming member 63 can be fitted therein later. The gap forming member 63 may be implemented as a thermally shrinkable tube formed of PFT (tetrafluoroethylene-per-fluoroalkylvinylether copolymer), FEP (tetrafluoroethylene-hexafluoropropyrene) copolymer or similar fluorine-based resin. Such resin has a high parting ability and therefore does not allow toner to easily deposit thereon.

Further, the insulative fluorine-based resin obviates discharge at the position of the gap forming member 63; otherwise, discharge products would accumulate on the drum 5 and increase the coefficient of friction of the drum 5 for thereby causing the member 63 to entrain the cleaning blade 47. Although the fluorine-based resin is difficult to adhere to resin because of the high parting ability, it can be affixed to the body of the charge roller 14 without resorting to an adhesive if fitted by thermal shrinkage.

The gap forming member 63 abuts against the drum 5 outside of the image forming range of the drum 5, forming a gap between the resin layer 62 of the charge roller 14 and the drum 5. A gear, not shown, mounted on the end of the core 61 is held in mesh with a gear, not shown, formed on a flange. In this configuration, when a drum drive motor, not shown, causes the drum 5 to rotate, the charge roller 14 also rotates at substantially the same speed as the drum 5.

Because the resin layer 62 and drum 5 do not contact each other, the drum 5 is protected from scratches even when the charge roller 14 and drum 5 are formed of hard resin and an organic photoconductor, respectively. The maximum gap should be 100 μm or less because an excessively large gap would bring about abnormal discharge and would therefore obstruct uniform charging. It is therefore necessary to provide both of the drum 5 and charge roller 14 with high accuracy, i.e., straightness of 20 μm or below.

Figure 4:
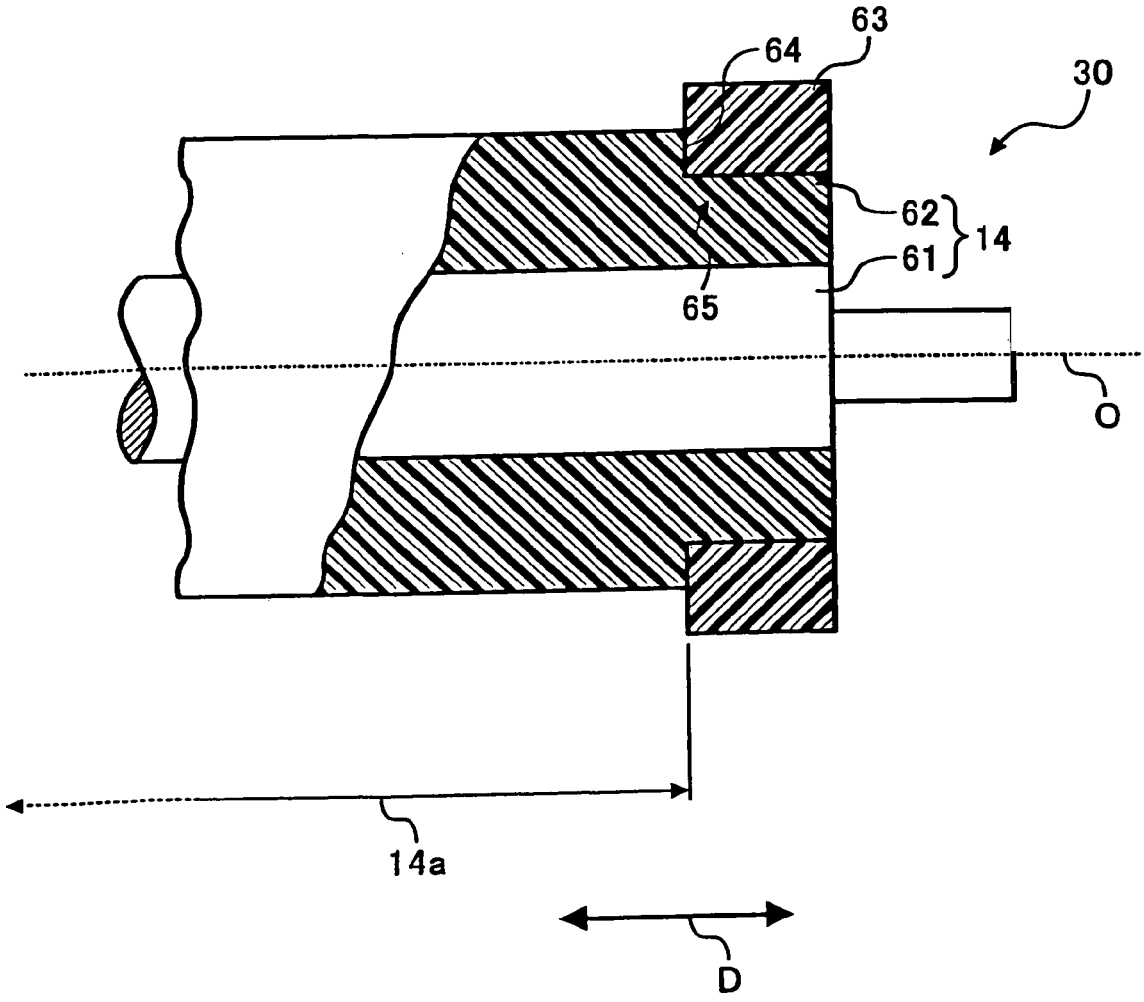
FIG. 4 is a section showing a modification of the charging device of FIG. 3.

FIG. 4 shows an alternative configuration of the stepped portion 64. The charge rollers 14 shown in FIGS. 3 and 4 each have a portion 14*a* corresponding to the image forming range of the drum 5, the maximum gap is 100 μm or less throughout the portion 14*a*.

More specifically, the charge roller 14 shown in FIG. 3 includes the first portion 14*a* corresponding to the image forming range of the drum 5 and delimited by opposite annular grooves 65 (only one is shown) in the axial direction D and a second portion 14*b* positioned closer to the end than the groove 65 and corresponding to a non-image forming range of the drum 5. On the other hand, the charge roller 14 shown in FIG. 4 includes only the first portion 14*a*. While the groove 65, which also corresponds to the non-image forming range of the drum 5, may be considered to form part of the second portion 14*b*, the portion closer to the end than the groove 65 in the axial direction D and corresponding to the non-image forming range of the drum 5 will be referred to as the second portion 14*b* in order to facilitate the understanding of the illustrative embodiment.

The charge roller 14 with the second portion 14*b* shown in FIG. 3 allows the thermally shrinkable gap forming member 63 to be fitted in the groove 65 without resorting to an adhesive and prevents the member 63 from slipping out. The charge roller 14 without the second portion 14*b* shown in FIG. 4 allows the groove 65 to be easily formed in its end portion. FIGS. 3 and 4 each are a section containing the axis O of the charge roller 14 indicated by a dash-and-dot line.

If the groove 65 formed by the stepped portion 64 is excessively shallow, then it cannot sufficiently prevent the gap forming member 63 from slipping out. If the groove 65 is excessively deep, then it makes strength short because the thickness of the resin layer 62 is limited in relation to the charging ability, as stated earlier. Further, because the target of the gap is determined by the charging ability, the gap forming member 63 cannot be implemented as a thermally shrinkable tube unless the stepped portion 64 is increased in size. The slip-preventing function and the strength of the resin layer 62 are compatible with each other if the ratio of the thickness of the resin layer 62 to that of the gap forming member or tube 63 is between 5 and 20. The illustrative embodiment therefore satisfies this condition.

The gap formed by the gap forming member 63 between the charge roller 14 and the drum 5 causes the load acting on the roller 14 to concentrate on the member or thermally shrinkable tube 63, so that the tube must be highly durable. Because the durability of the above tube is susceptible to both of the width and thickness of the tube, durability increases with an increase in sectional area.

Thermally shrinkable tubes in general each have a thickness deviation of about ±10%, so that the variation of the gap increases with an increase in thickness. It follows that an excessively thick tube is not usable. Further, the length of the charge roller 14 increases with an increase in the width of the tube, rendering the printer 100 bulky.

In light of the above and considering the results of various experiments, the area of the gap forming member 63 in a section, which contains the axis O of the charge roller 14, should preferably be between $1.0\times10^{-6}$ $m^2$ and $3.0\times10^{-6}$ $m^2$ from the standpoint of the durability of the tube and gap accuracy. It is to be noted that the above sectional area of the tube is one that holds after the tube has been fitted on the charge roller 14 by thermal shrinkage. To reduce the size of the printer 100 and enhance gap accuracy, the ratio of the width to the thickness of the gap forming member 63 should preferably be between 25 and 100. The illustrative embodiment satisfies all of such conditions.

The gap between the charge roller 14 and the drum 5 constantly varies within a preselected range when the drum 5 and charge roller 14 are in rotation. To uniformly charge the drum 5 in this situation, it is preferable to superpose on a DC voltage an AC voltage whose peak-to-peak voltage is two times or more as high as a discharge start voltage between the charge roller 14 and the drum 5. If the frequency of the AC voltage to be superposed on the DC voltage is low, then stripe-like irregular charging is conspicuous. To solve this problem, the frequency (Hz) of the AC voltage should preferably be seven times or more higher than the linear velocity (mm/sec) of the drum 5. In the illustrative embodiment, voltage applying means, not shown, applies a voltage satisfying the above conditions to the resin layer 62.

Referring again to FIG. 2, the cleaning brush 49, positioned above the charge roller 14 for cleaning it, has a metallic core having a diameter of 4 mm and in which 2 mm long, conductive bristles are electrostatically implanted. The cleaning brush 49 rotatably contacts the charge roller 14 with its own weight only and cleans the charge roller 14 while being rotated by the charge roller 14. Because a spring or similar pressing means is not used, the deformation of the core 61 does not matter at all even if the diameter of the core 61 is small.

When the length of the cleaning brush 49, as measured in the axial direction D, is made greater than the length of the length of the charge roller 14 inclusive of portions covered with the opposite gap forming members 63, i.e., the length of the portion covered with the resin layer 62, the cleaning brush 49 can clean the gap forming members 63 at the same time. At this instant, the outside diameter of the charge roller 14 differs from the first portion 14*a* to the portions covered with the gap forming members 63. However, the difference is only about several micrometers or 100 μm or less at most, which is sufficiently smaller than the length of the bristles of the cleaning brush 49, and therefore does not degrade the cleaning of the first portion 14*a*.

The length of the cleaning brush 49 must be at least equal to the distance between the end of one gap forming member 63 close to one end of the charge roller 14 and the end of the other gap forming member 63 close to the other end of the charge roller 14, so that the cleaning brush 49 can contact the opposite gap forming members 63 and clean the members 63 and charge roller 14 at the same time. Preferably, the length of the cleaning brush 49 should be greater than the length of the portion of the charge roller 14 covered with the resin layer 62, so that the cleaning brush 49 contacts the entirety of the above portion.

An example of the illustrative embodiment and comparative examples will be described hereinafter.

EXAMPLE 1

The charge roller 14 was produced by the following procedure. The core 61 was formed of stainless steel and provided with a diameter of 8 mm. To form the resin layer 62, 60 pts. wt. of ion-conductive agent was added to 100 pts. wt. of ABS resin to prepare a resin component having volumetric resistivity of $10^6$ Ω·cm. Injection molding was effected with the above resin component to form the resin layer 62 on the core 61. Subsequently, the surface of the resin layer 62 was machined to provide the charge roller 14 with a diameter of 12 mm. At this instant, the stepped portions 64 were formed in opposite end portions of the resin layer 62 to thereby form the annular grooves 65 having width of 8 mm each. Subsequently, a 150 μm thick PFA tube was cut to produce two 8 mm wide, gap forming members 63. The two gap forming members 63 each were fitted in one of the annular grooves 65 and caused to shrink by being heated for 20 minutes in a 120° C. atmosphere. When the charge roller 14 thus produced was mounted to a drum unit included in a color printer IPSio Color 8000 (trade name) available from RICOH CO., LTD., the mean gap between the image range of the drum 5 and the charge roller 14 was about 45 μm; the maximum and minimum gaps were 65 μm and 25 μm, respectively. To measure the gap, use was made of a laser scan micrometer LSM-600 (trade name) available from Mitsutoyo and a method described in the papers of Japan Hardcopy 2001. Prints were output by IPSio Color 8000 in which the drum 5 was rotated at a linear velocity of 125 mm/sec. The charge bias contained a DC component of −700 and an AC component implemented as a sinusoidal wave having a peak-to-peak voltage of 2.2 kV and a frequency of 900 Hz.

When 50,000 prints were continuously output under the conditions stated above, image quality was desirable throughout the operation. The tubes, constituting the gap forming members 63, remained in a desirable condition even after the production of 50,000 prints, maintaining the gap comparable with the initial gap. Further, the resin layer 62 was smeared little.

COMPARATIVE EXAMPLE 1

Comparative Example 1 was identical with Example except that the annular grooves formed in the resin layer 62 were 25 μm deep each and that the PFA tube was 75 μm thick. When the resulting charge roller was mounted to the drum unit of IPSio Color 8000, the mean gap between the drum 5 and the charge roller was about 45 μm; the maximum and minimum gaps were 55 μm and 35 μm, respectively.

When 50,000 prints were continuously output under the above conditions, image quality was initially desirable, but fine spot-like smears started to appear in part of an image when about 30,000 prints were produced. By confirming the drum unit, it was found that the tubes, constituting the gap forming members, lost elasticity and got on the stepped portions 64 and that toner was stuffed between the tubes and the resin layer 62 and enlarged the gap.

COMPARATIVE EXAMPLE 2

Comparative Example 2 was identical with Example except that the annular grooves formed in the resin layer 62 were 400 μm deep and that the PFA tube was 450 μm thick. When the resulting charge roller was mounted to the drum unit of IPSio Color 8000, the mean gap between the drum 5 and the charge roller was about 45 μm; the maximum gap was 95 μm. The drum 5 and charge roller partly contacted each other within the image range of the drum 5.

When 50,000 prints were continuously output under the same conditions as in Example, the image quality was initially desirable, but irregularity started to appear in part of a halftone image in the period of the charge roller when about 40,000 prints were output. By confirming the drum unit, it was found that although the tubes remained in a desirable condition, part of the charge roller was partly noticeably smeared around portions where the charge roller and drum 5 contacted each other.

In the printer 100 with the charging device 30 of the illustrative embodiment, the charging device 30 successfully uniformly charges the surface of the drum 5 in both of the full-color and black-and-white modes, insuring high image quality at all times despite aging.

As stated above, the illustrative embodiment has various unprecedented advantages, as enumerated below.

(1) The gap between the charge roller 14 and the drum or image carrier 5 protects the charge roller 14 from smears.

(2) The gap forming members 63 are highly durable and maintain the gap accurate.

(3) The gap forming members 63 are fitted on the charge roller 14 without resorting to an adhesive and prevented from slipping out.

(4) The charge roller 14 is easy to machine and accurate.

(5) Not only the size of the charge roller 14 does not increase, but also the strength of the charge roller 14 is prevented from decreasing.

(6) The charge roller 14 has a parting ability high enough to allow a minimum of toner to deposit and can therefore desirably charge the drum 5 over a long time.

(7) Leak is prevented from occurring at positions where the gap forming members 63 contact the drum 5, so that the problem stated earlier is obviated.

(8) There can be enhanced the uniform charge potential and stability against the varying environment even when the gap varies.

(9) Abnormal discharge is obviated, so that the charge roller 14 can uniformly charge the drum 5.

(10) Even when the gap needs high accuracy, even the user of the printer 100 can perform replacement without any adjustment. This not only promotes desirable image formation, but also facilitates replacement by the user.

Second Embodiment

A second embodiment of the image forming apparatus will be described with reference to FIG. 5 hereinafter. This embodiment is substantially identical with the first embodiment shown in FIGS. 1 and 2 as to the construction and operation. The following description will concentrate on differences between the first and second embodiments.

Figure 5:
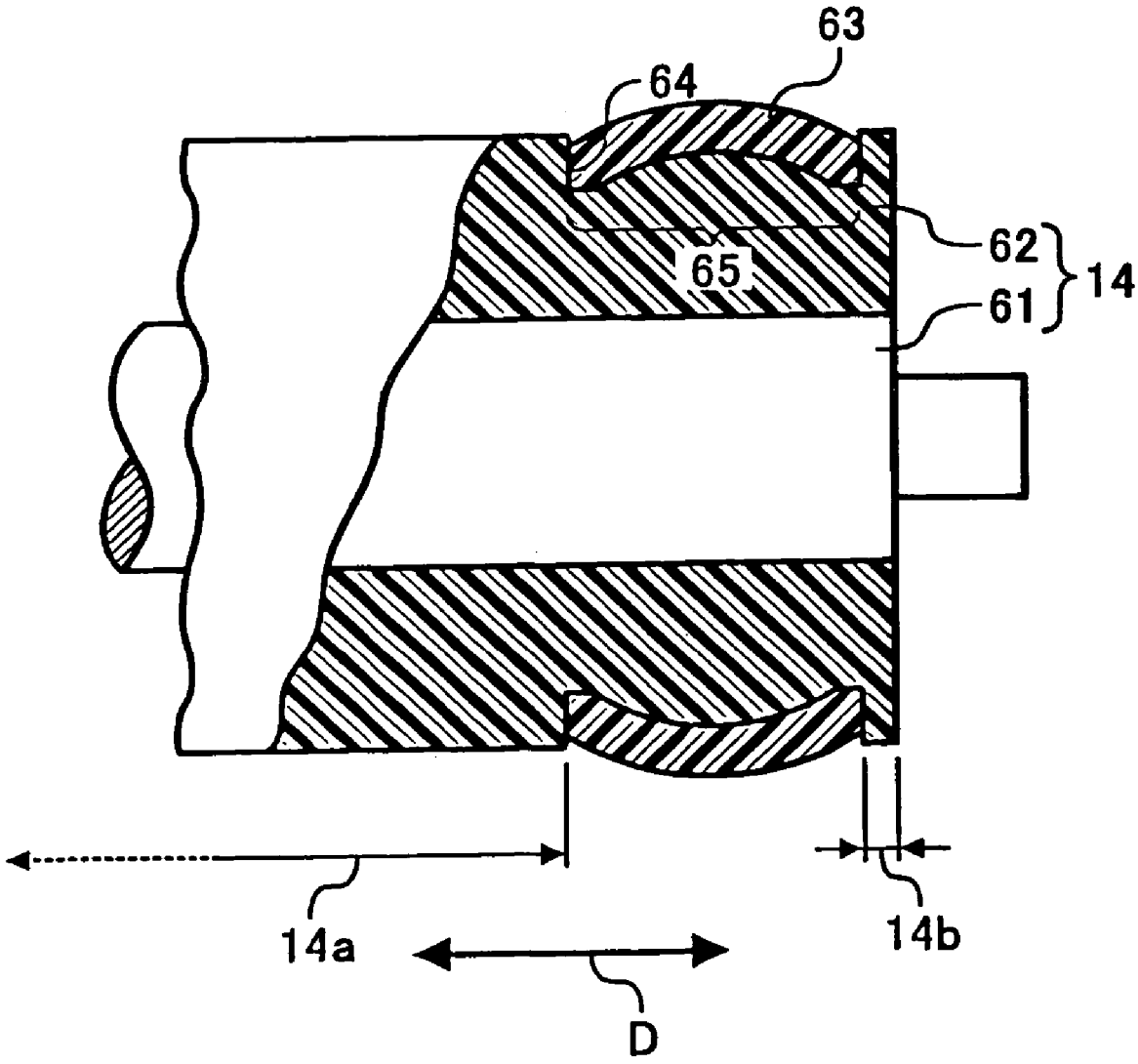
FIG. 5 is a section showing one end portion of a charging device representative of a second embodiment of the present invention.

FIG. 5 shows in a section the charge roller 14 and gap forming member 63 included in the illustrative embodiment. As shown, the gap forming member 63, stepped portion 64 and annular groove 65 differ in configuration from the corresponding constituents shown in FIG. 3. As for the rest of the configuration, the illustrative embodiment is identical with the first embodiment. Of course, reference numerals shown in FIG. 5 correspond to the reference numerals shown in FIG. 3.

Figure 6:
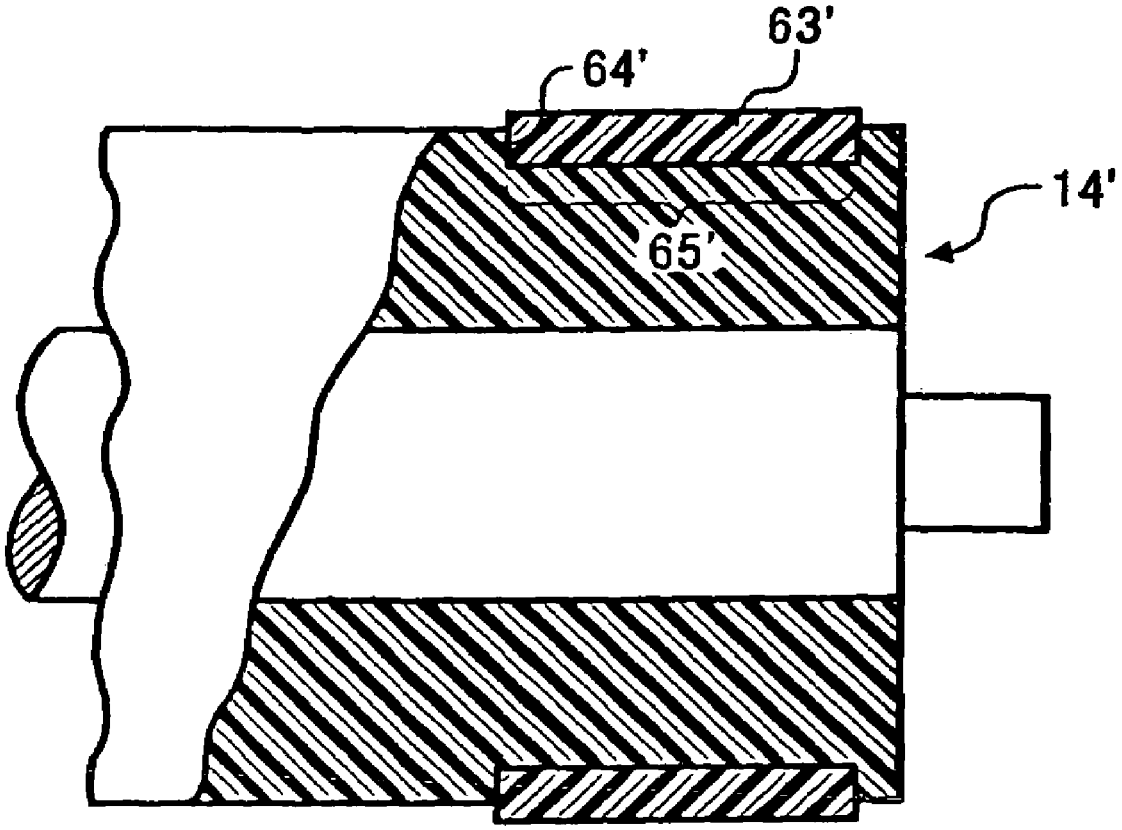
FIG. 6 is a section showing one end portion of the charging device using thin tubes.

When the gap forming member 63 is implemented as thermally shrinkable tube that must be highly durable, durability can be insured if the tube is sufficiently thick, as stated earlier. However, an increase in the thickness of the tube directly translates into an increase in the variation of the gap ascribable to the tube because the thickness of the tube has a deviation of about ±10%, as also stated earlier. In this sense, the tube should preferably be as thin as possible. However, as shown in FIG. 6, if the bottom of an annular groove 65', formed by a stepped portion 64', is straight in a section, then a gap forming member 63', implemented as a thin tube and fitted in the groove 65', gets on the stepped portion 64' and enlarges the gap when slightly extended. As a result, abnormal discharge is apt to occur or the gap forming member 63' is apt to start breaking at the edge gotten on the stepped portion 64'.

In the illustrative embodiment, as shown in FIG. 5, the annular groove 65 is so configured to be deeper at opposite end portions in the axial direction D of the charge roller 14 than at the center portion. Therefore, the groove 65 has an arcuate bottom, as viewed in a section, becoming deeper from the center toward opposite ends. This reduces a force acting on the ends of the gap forming member or tube 63 and therefore prevents the ends of the member 63 from extending and getting on the stepped portion 64. Although the center portion of the gap forming member 63 may slightly stretch, the member 63 has little influence on the gap only if the charge roller 14 is pressed against the drum 5 by, e.g., a spring.

Figure 7:
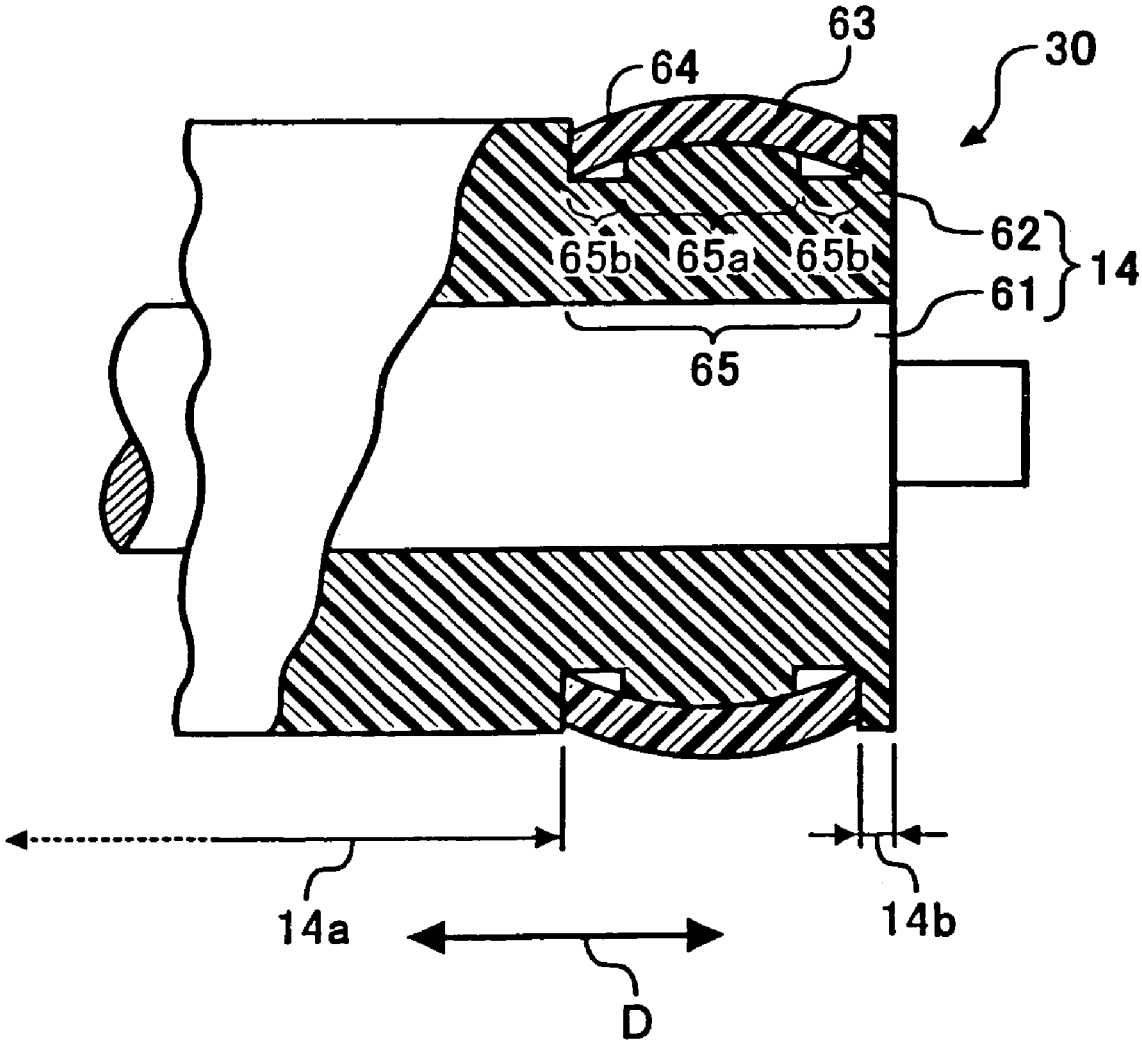
FIG. 7 is a section showing a modification of the charging device of FIG. 5.

FIG. 7 shows a modified form of the annular groove 65. As shown, the groove 65 is made up of a first or center portion 65*a* positioned at the center in the axial direction D and second portions 65*b* positioned at both sides of the first portion 65*a* and deeper than the first portion 65*a*. Stated another way, a step is formed within the groove 65. This configuration achieves the same advantages as the configuration of FIG. 5 despite that the first and second portions 65*a* and 65*b* each are flat. In addition, the bottom, made up of the flat first and second portions 65*a* and 65*b*, is easier to machine than the bottom of the groove 65 of FIG. 5.

The gap forming member 63, fitted in the recess formed by the annular groove 65, is prevented from being shifted in position. However, discharge is apt to occur from the charge roller 14 toward the drum 5 in the second portion 14*b*, as stated previously. In the configuration shown in FIG. 6, if the outside diameter of the charge roller 14' is reduced at the portion closer to the end than the gap forming member 63', then the groove 65' fails to sufficiently prevent the gap forming member 63' from being shifted or causes it to slip out of the groove 65'.

Figure 8:
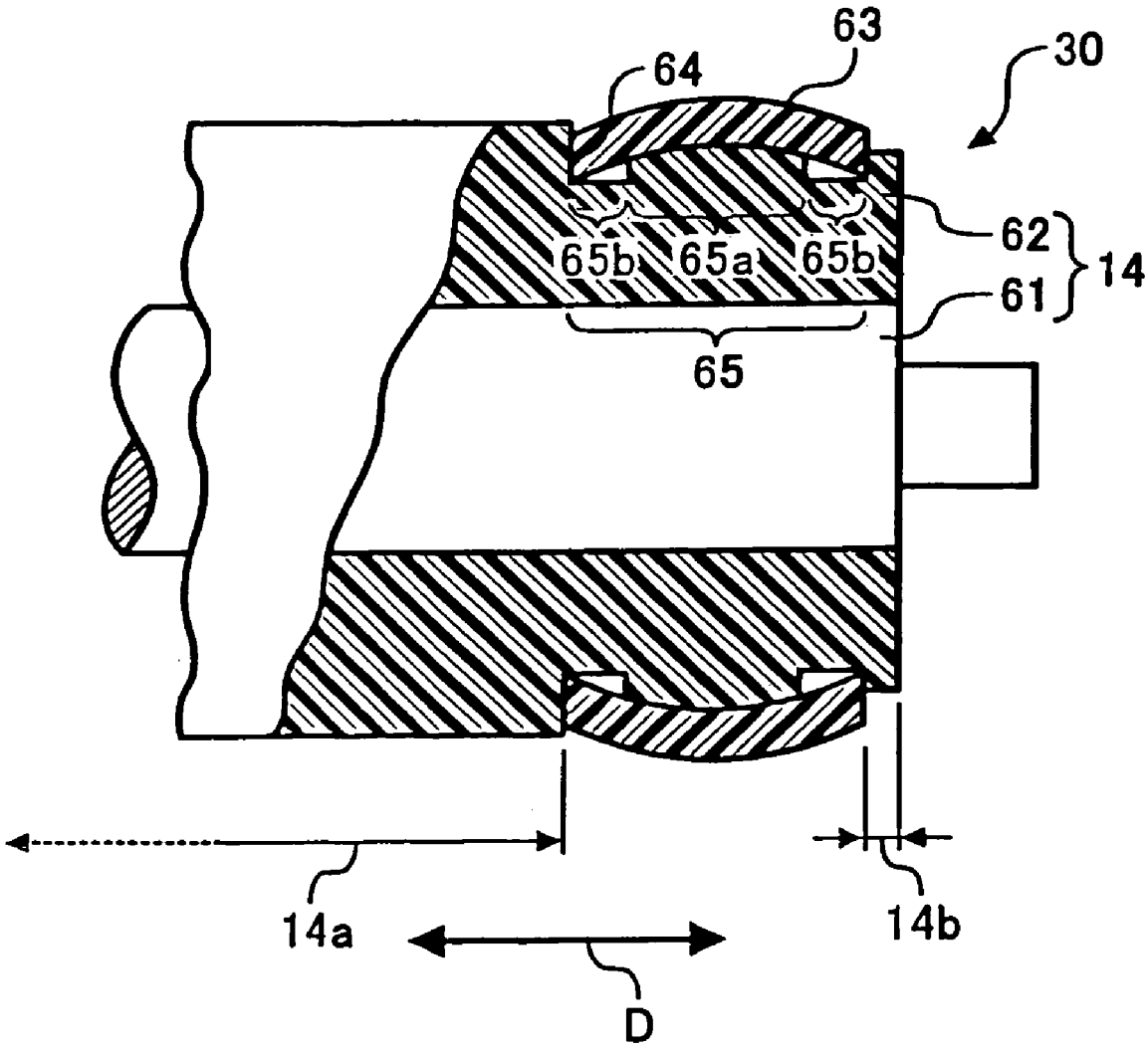
FIG. 8 is a section showing another modification of the charging device.

To solve the above problem, as shown in FIG. 8, the outside diameter of the second portion 14*b* may be made smaller than the outside diameter of the first portion 14*a* in either one of the configurations shown in FIGS. 5 and 7. This is successful to achieve both of the function of preventing the gap forming member 63 from slipping out of the groove 65 and the obviation of discharge at the second portion 14*b*.

An example of the illustrative embodiment and a comparative example will be described hereinafter.

EXAMPLE

The charge roller 14 was produced by the following procedure. The core 61 was formed of stainless steel and provided with a diameter of 8 mm. To form the resin layer 62, 60 pts. wt. of ion-conductive agent was added to 100 pts. wt of ABS resin to prepare a resin component having volumetric resistivity of $10^6$ Ω·cm. Injection molding was effected with the above resin component to form the resin layer 62 on the core 61. Subsequently, the surface of the resin layer 62 was machined to provide the charge roller 14 with a diameter of 12 mm. At this instant, the stepped portions 64 were formed in opposite end portions of the resin layer 62 to thereby form the annular grooves 65 having width of 8 mm each. Each groove 65 was 50 μm deep at the center or first portion 65*a* and 150 μm deep at the opposite ends or second portions 65*b*. Subsequently, a 150 μm thick PFA tube was cut to produce two 8 mm wide, gap forming members 63. The two gap forming members 63 each were fitted in one of the annular grooves 65 and caused to shrink by being heated for 20 minutes in a 120° C. atmosphere. The charge roller 14 thus produced was mounted to a drum unit included IPSio Color 8000 mentioned earlier, and the drum 5 was rotated at a linear velocity of 125 mm/sec. The charge bias contained a DC component of −700 and an AC component implemented as a sinusoidal wave having a peak-to-peak voltage of 2.2 kV and a frequency of 900 Hz.

When 50,000 prints were continuously output under the conditions stated above, image quality was desirable throughout the operation. The tubes, constituting the gap forming members 63, remained in a desirable condition at the opposite end portions although it slightly bulged out at the center portion in the axial direction D.

COMPARATIVE EXAMPLE

Comparative Example was identical with Example except that the annular grooves formed in the resin layer 62 were 50 μm deep each. When the resulting charge roller was mounted to the drum unit of IPSio Color 8000 and 50,000 prints were continuously output under the above conditions, image quality was initially desirable, but fine spot-like smears started to appear in part of an image when about 40,000 prints were produced. By confirming the drum unit, it was found that the tubes, constituting the gap forming members, extended and got on the stepped portions 64 and enlarged the gap, resulting in abnormal discharge and therefore smears mentioned above.

As stated above, the illustrative embodiment achieves the following advantages in addition to the advantages of the first embodiment. By preventing the gap forming member 63 from getting on the stepped portion that forms the groove, it is possible to prevent the gap forming member 63 from being deteriorated. Undesirable discharge at the second portion of the charge roller 14 is obviated, so that the drum 5 is protected from wear. It is therefore possible to obviate the leak of the charge bias and to prevent the gap from being enlarged due to the deposition of toner ascribable to defective cleaning of the drum 5 for thereby obviating irregular charging ascribable to abnormal discharge.

Third Embodiment

Figure 9:
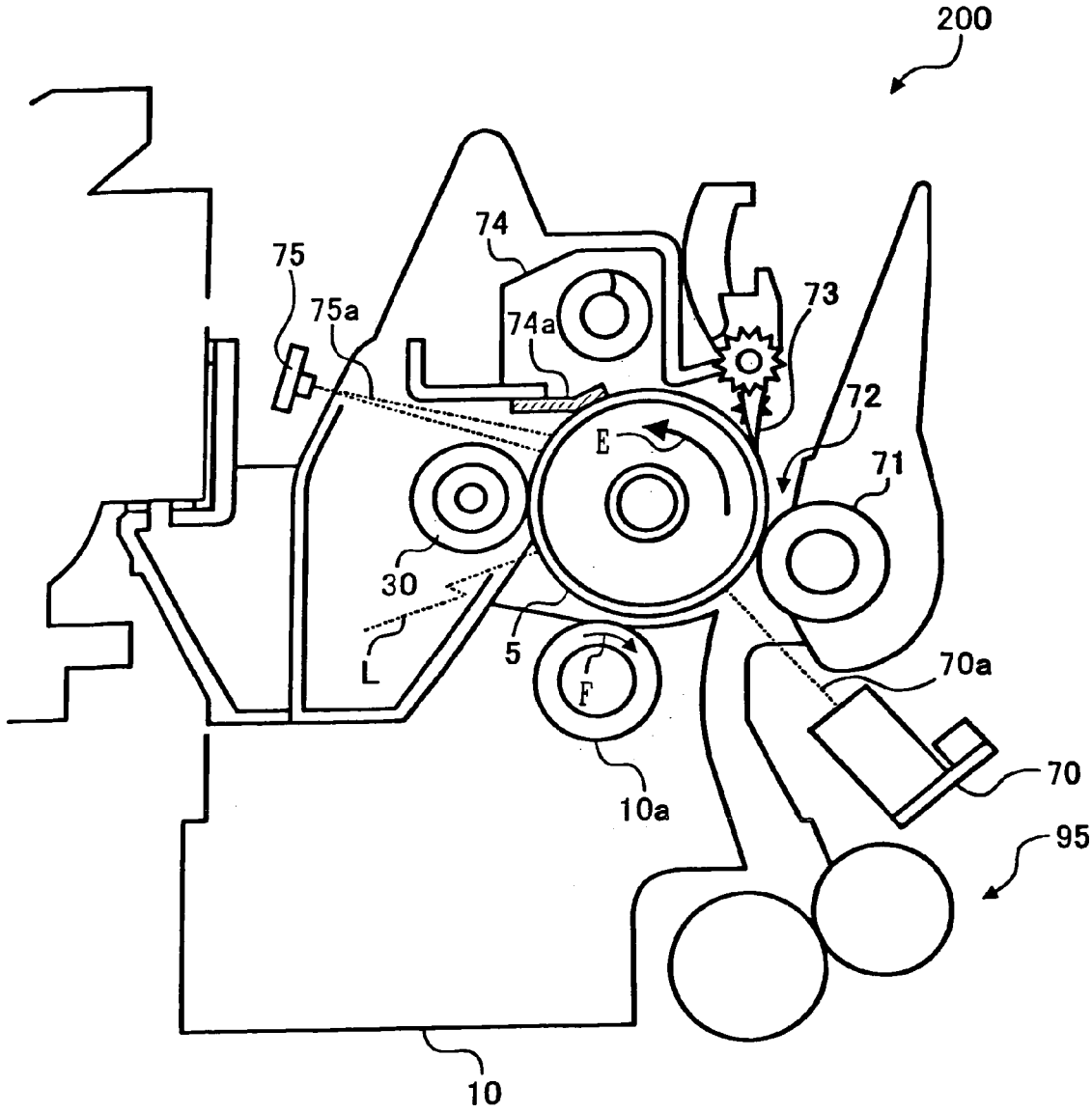
FIG. 9 is a section showing a third embodiment of the present invention.

Reference will be made to FIG. 9 for describing a third embodiment of the present invention implemented as a monochromatic printer by way of example. In the illustrative embodiment, the printer is also capable of fixing a toner image on a sheet-like recording medium, i.e., any one of a plain paper customary with, e.g., a copier, an OHP (Over-Head Projector) film, a card, postcard or similar 90K sheet, and a thick sheet, envelope or similar special sheet having weight of about 100 g/m$^2$ or above and larger in thermal capacity than a plain paper. The recording medium may be of A4, A3 or similar regular size or of irregular size, as desired.

As shown in FIG. 9, the printer, generally 200, includes a photoconductive drum or image carrier 5 coated with, e.g., an organic photoconductor and rotatable in a direction indicated by an arrow E. A charging device or charging means 30 uniformly charges the surface of the drum 5. A writing unit or writing means, not shown, scans the charged surface of the drum 5 with a laser beam L in accordance with image data to thereby form a latent image on the drum 5.

A developing device or developing means 10 develops the latent image formed on the drum 5 to thereby form a corresponding toner image. A quenching device 70 discharges the drum 5 with light 70*a* after development. An image transfer roller or image transferring means 71 electrostatically transfers the toner image from the drum 5 to a sheet or sheet-like recording medium not shown. A registration roller pair 95 conveys, at preselected timing, the sheet to an image transfer position 72 where the drum 5 and image transfer roller 71 face each other.

A peeler or peeling means 73 peels off the sheet from the drum 5 after image transfer. A cleaning device or cleaning means 74 scrapes off residual toner left on the drum 5 after image transfer to thereby clean the drum 5. A quenching device or quenching means 75 discharges the drum 5 with light 75*a* before the drum 5 is charged by the charging device 30.

A pickup roller or sheet feeding means, not shown, pays out sheets stacked on a sheet tray, not shown, toward a registration roller pair 95 one by one. A fixing unit or fixing device, not shown, fixes the toner image transferred from the drum 5 to the sheet. The sheet, carrying the toner image fixed thereon, is driven out of the printer 200.

The developing device 10 includes a developing roller 10*a* rotatable in a direction F, which is coincident with the direction E as seen at a position where the roller 10*a* faces the drum 5. The cleaning device 74 removes residual toner and impurities including paper dust from the surface of the drum 5 with a blade 74*a*. The image transfer roller 71 may be replaced with an image transfer charger or an image transfer belt by way of example. The drum 5 is implemented as an OPC (Organic PhotoConductor) drum having an outside diameter of 30 mm. A 5 μm thick protection layer, not shown, is formed on the surface of the drum 5 and contains a filler. The charging device 30 and drum 5 are constructed into a single process cartridge removably mounted to the printer 200.

Figure 10:
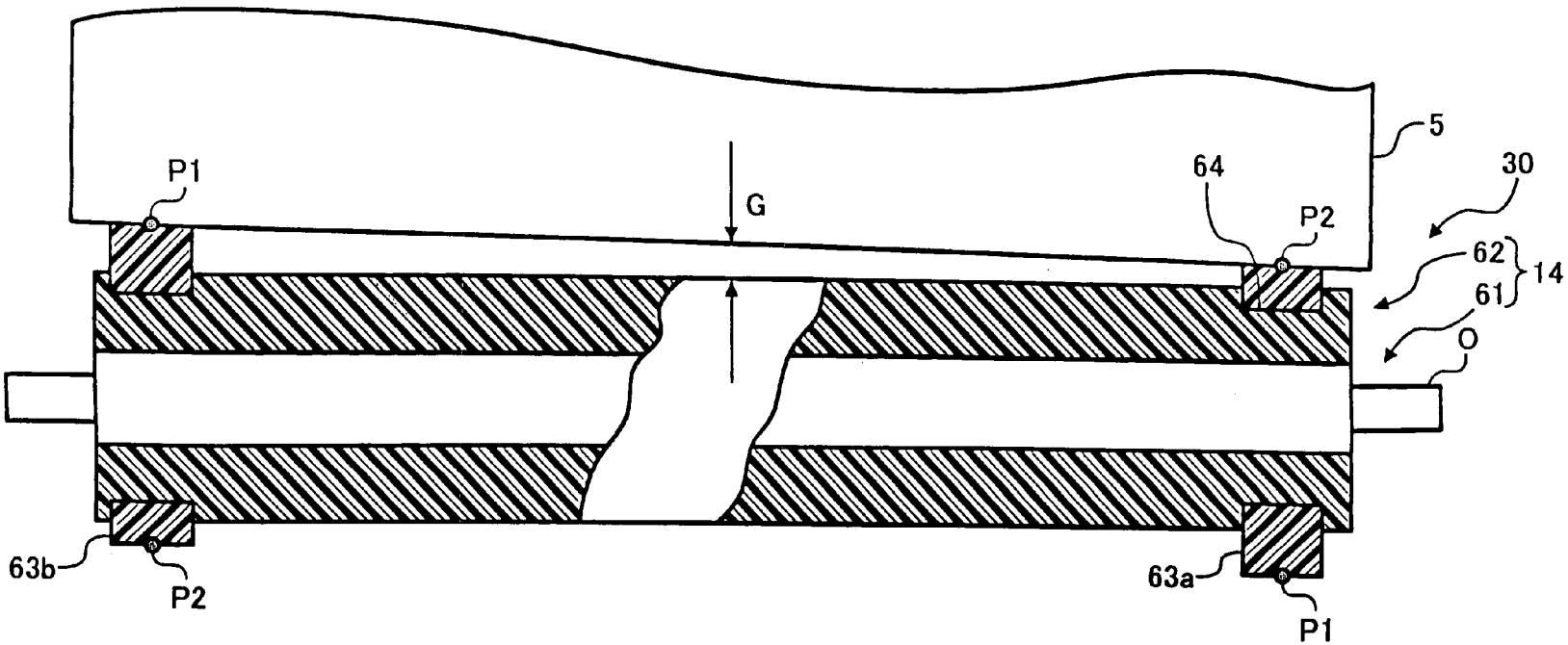
FIG. 10 is a section showing a charging device included in the third embodiment.

FIG. 10 shows the charging device 30 in detail. As shown, the charging device 30 includes a charge roller 14 formed with annular stepped portions 64 in opposite end portions thereof. Annular tubes or regulating members 63*a* and 63*b*, corresponding to the gap forming members of the first and second embodiments, are fitted in the stepped portions 64. The charge roller 14 has an outside diameter of 12 mm and is made up of a metallic core 61 having an axis O and a resin layer 62 formed on the core 61 and consisting mainly of ABS resin. The tubes 63*a* and 63*b* are implemented by PFA tubes available from GUNZE LTD. and having thickness of 300 μm.

The stepped portions 64 each are formed by a 8 mm wide, 250 μm deep annular groove, so that a 50 μm charge gap G is formed between the resin layer 62 of the charge roller 14 and the drum 5. The tubes 63*a* and 63*b*, which are thermally shrinkable, are fitted in the stepped portions 64 by being heated for 20 minutes in a 120° C. atmosphere. The resin layer 62 contains an ion-conductive substance. The tubes 63*a* and 63*b* are produced by cutting a single, elongate thermally shrinkable tube and lower in hardness than the resin layer 62.

As shown in FIG. 10 the tubes 63*a* and 63*b*, fitted in the opposite end portions of the charge roller 14, are positioned on the charge roller 14 in phases different from each other, i.e., shifted by 180° for purposes to be described hereinafter.

Figure 11:
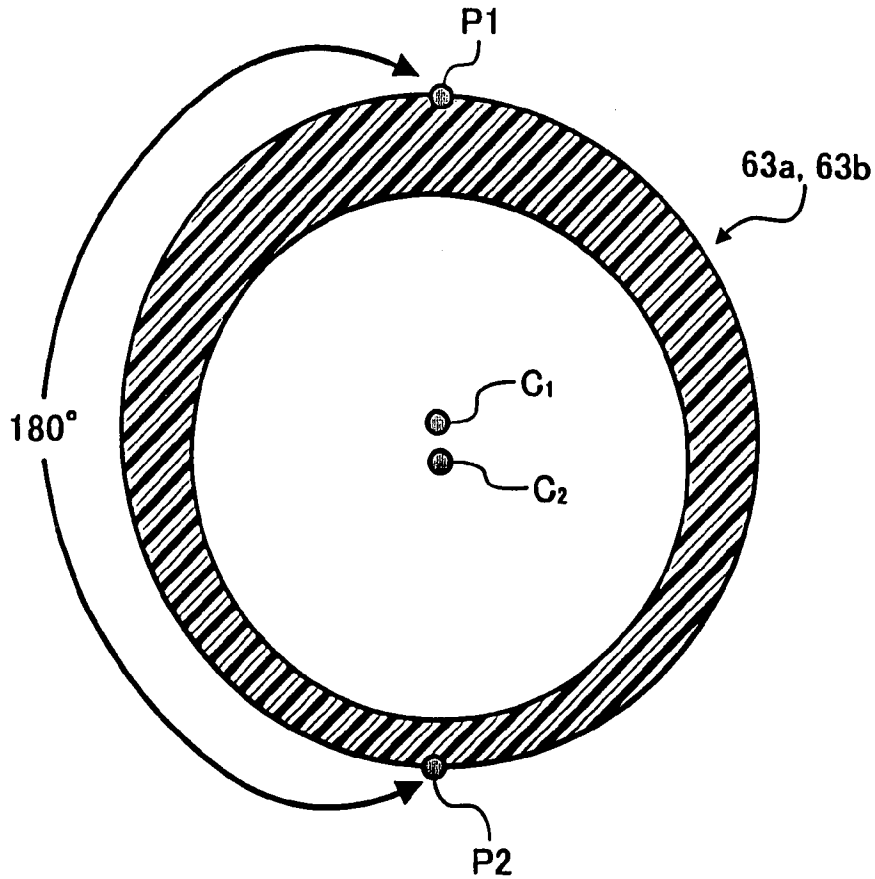
FIG. 11 is a section showing a tube included in the charging device of FIG. 10.

FIG. 11 is a section showing a specific condition wherein the wall thickness the tube 63*a* or 63*b* is not uniform in the circumferential direction. The tube 63*a* or 63*b* is produced by cutting an elongate tube formed by extrusion molding. Extrusion molding is effected by use of a mold made up of a tubular outer part and a roller-like inner part and by extruding a material introduced into a gap between the outer and inner parts in the axial direction, thereby producing an elongate tube. If the relative position of the outer and inner parts is slightly eccentric, then the center C1 of the outer circumference and the center C2 of the circular bore are shifted from each other; the shift is generally about ±10% of the wall thickness. Consequently, a thickness peak P1 and a thinness peak P2 are shifted from each other by 180° with respect to the center C1 in the circumferential direction.

Figure 12:
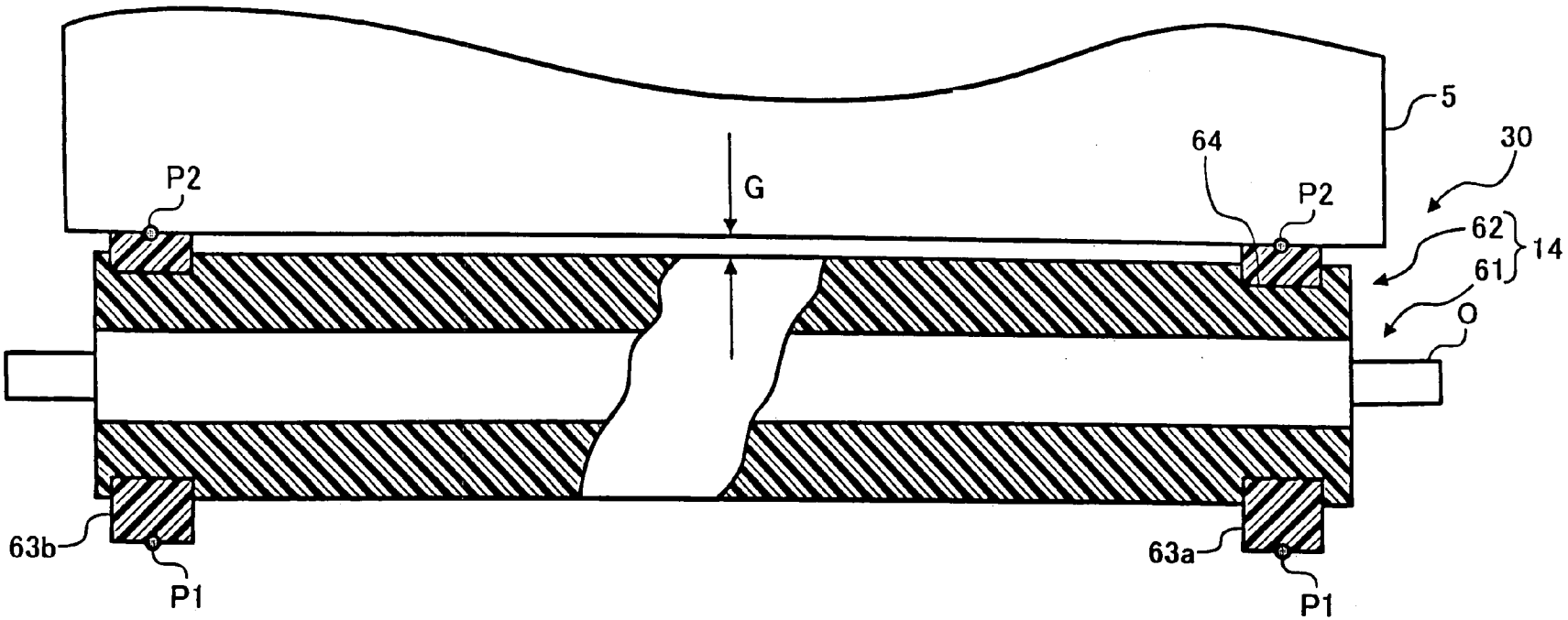
FIG. 12 is a section showing a specific comparative example of the charging device.

As shown in FIG. 12, assume that the tubes 63*a* and 63*b*, each having the configuration shown in FIG. 11, are fitted on the opposite end portions of the charge roller 14 such that their thickness peaks P1 align with each other in the circumferential direction of the charge roller 14. Then, when the thinness peak P2 of one tube 63*a* contacts the drum 5, the thinness peak P2 of the other tube 63*b* also contacts the drum 5, making the charge gap G extremely narrow. In this condition, the center portion of the charge roller 14 is apt to contact the drum 5.

In the illustrative embodiment, as shown in FIG. 10, the tubes 63*a* and 63*b* are positioned on the charge roller 14 such that their thickness peaks P1 are shifted from each other by 180° in the circumferential direction. It will be seen that when the thinness peak P2 of one tube 63*a* contacts the drum 5, the thickness peak P1 of the other tube 63*b* contacts the drum 5. Consequently, the thickness peak P1 broadens the gap G and buffers a decrease in gap G ascribable to the thinness peak P2. This successfully prevents the entire gap G from decreasing when the thinness peak P2 contacts the drum 5.

Figure 13:
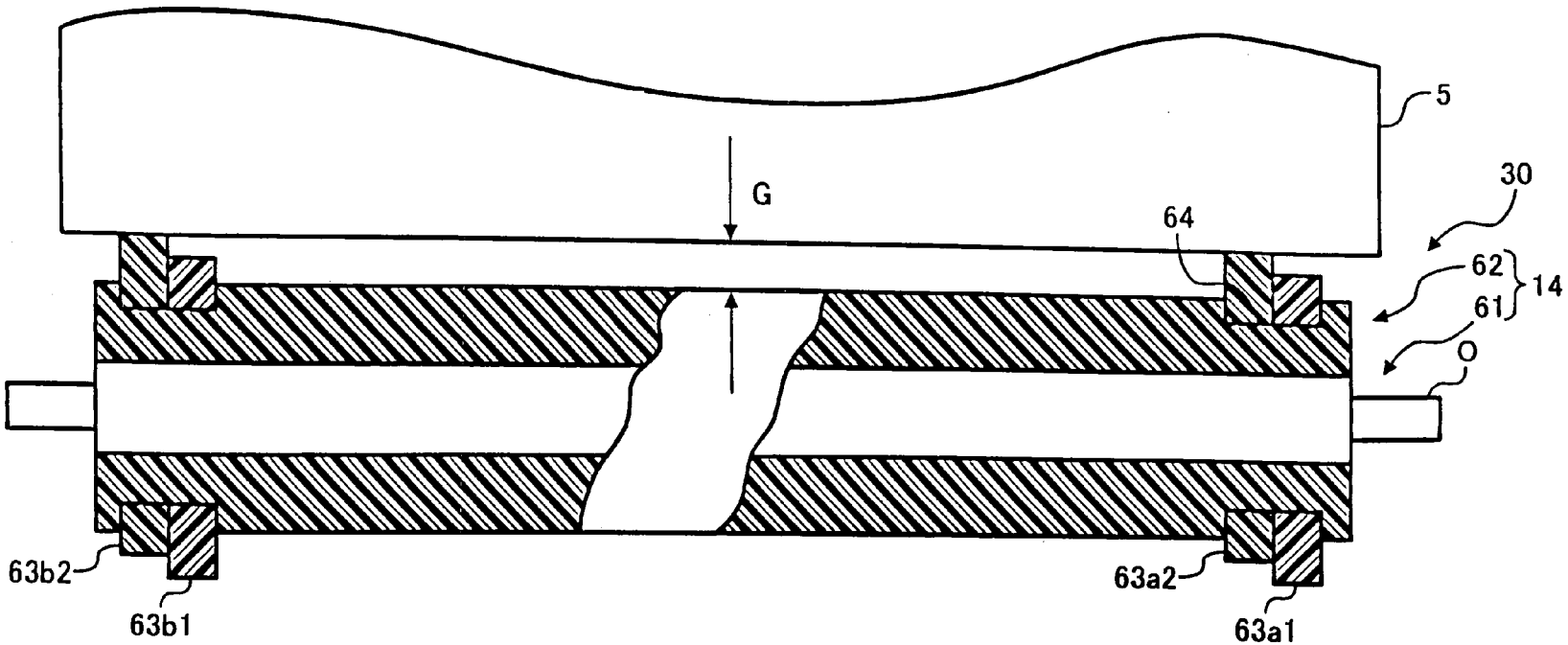
FIG. 13 is a section showing another specific configuration of the charging device.

FIG. 13 shows a modification of the illustrative embodiment. As shown, a plurality of (two in the modification) tubes 63*a*1 and 63*a*2 and a plurality of (two in the modification) tubes 63*b*1 and 63*b*2 are respectively fitted on the opposite end portions of the charge roller 14. The tubes 63*a*1 and 63*a*2, adjoining each other, are shifted in phase from each other by 180°, and so are the tubes 63*b*1 and 63*b*2 adjoining each other. On the other hand, one tube 63*a*1 positioned in one end portion and one tube 63*b*1 positioned in the other end portion are coincident in phase with each other, and so are the other tube 63*a*2 in one end portion and the other tube 63*b*2 in the other end portion.

In the configuration shown in FIG. 13, the thicker portions of the tubes 63*a*1, 63*a*2, 63*b*1 and 63*b*2 determine the gap G and implement accuracy as high as when the thickness deviation is halved. Presumably, by controlling the phases of the outermost tubes 63*a*1 and 63*b*2, it is possible to further stabilize the gap G.

Experiments were conducted to confirm the effects achievable with the tubes and shifted phases thereof. For experiments, there were prepared four different charge rollers (1) through (4):

(1) a charge roller with 8 mm wide tubes positioned at opposite ends and shifted in phase by 180°

(2) a charge roller with four 4 mm wide tubes fitted thereon, two shifted in phase by 180° at one end and the other two shifted in phase by 180° at the other end; the outermost tubes being coincident in phase (3) a charge roller with 8 mm wide tubes positioned at opposite ends without any phase shift (4) a charge roller with a 8 mm wide, 50 m thick PET (polyethylene terephthalate) tape adhered thereto and lacking the grooves.

The charge rollers (1) and (2) are respectively based on the illustrative embodiment and modification thereof and will be referred to as examples 1 and 2 hereinafter. The charge rollers (3) and (4) will be referred to as comparative examples 1 and 2, respectively, hereinafter.

Five rollers based on example 1, five rollers based on example 2, five rollers based on comparative example 1 and four rollers based on comparative example 2 were prepared. The gap G between the body of each roller and the drum 5 was measured at the front (F), center (C) and rear (R) of the printer by use of the laser scan micrometer LSM-600 mentioned earlier. For details of measurement, reference may be made to the papers of Japan hardcopy 2001 also mentioned earlier.

Figure 14:
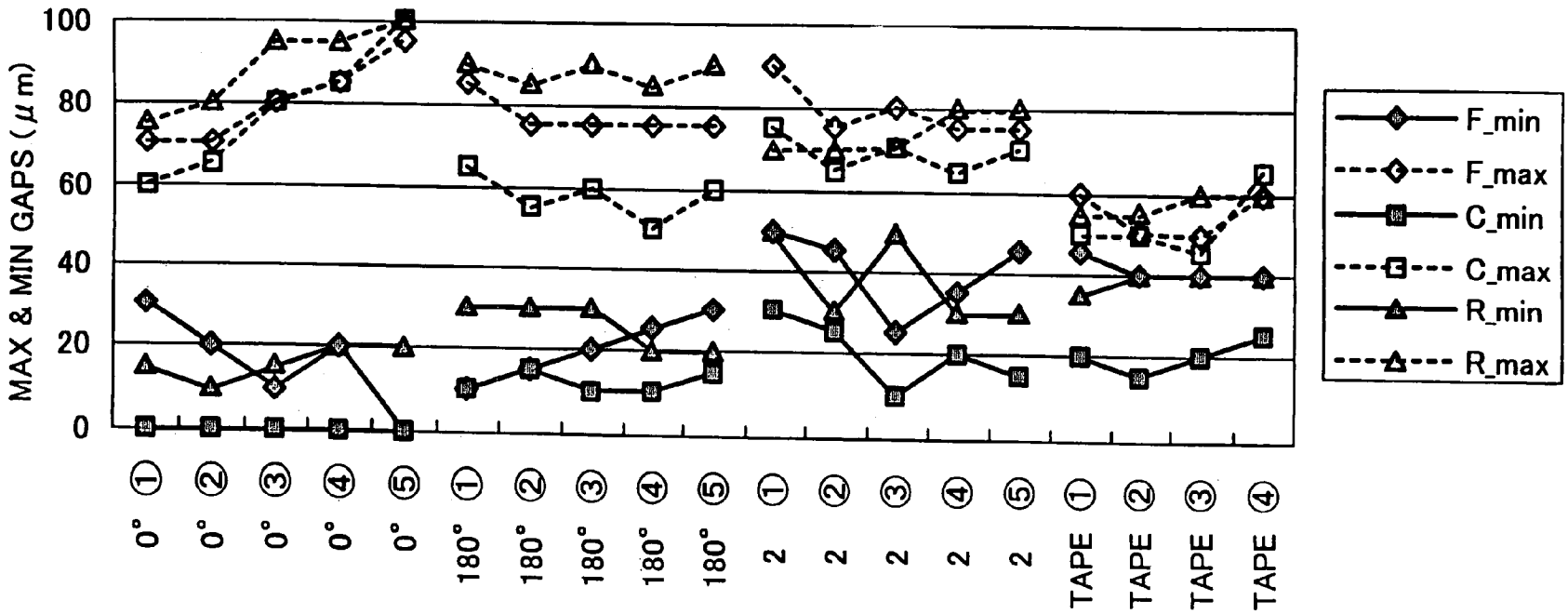
FIG. 14 is a plot showing gaps between various rollers and an image carrier.
Figure 15:
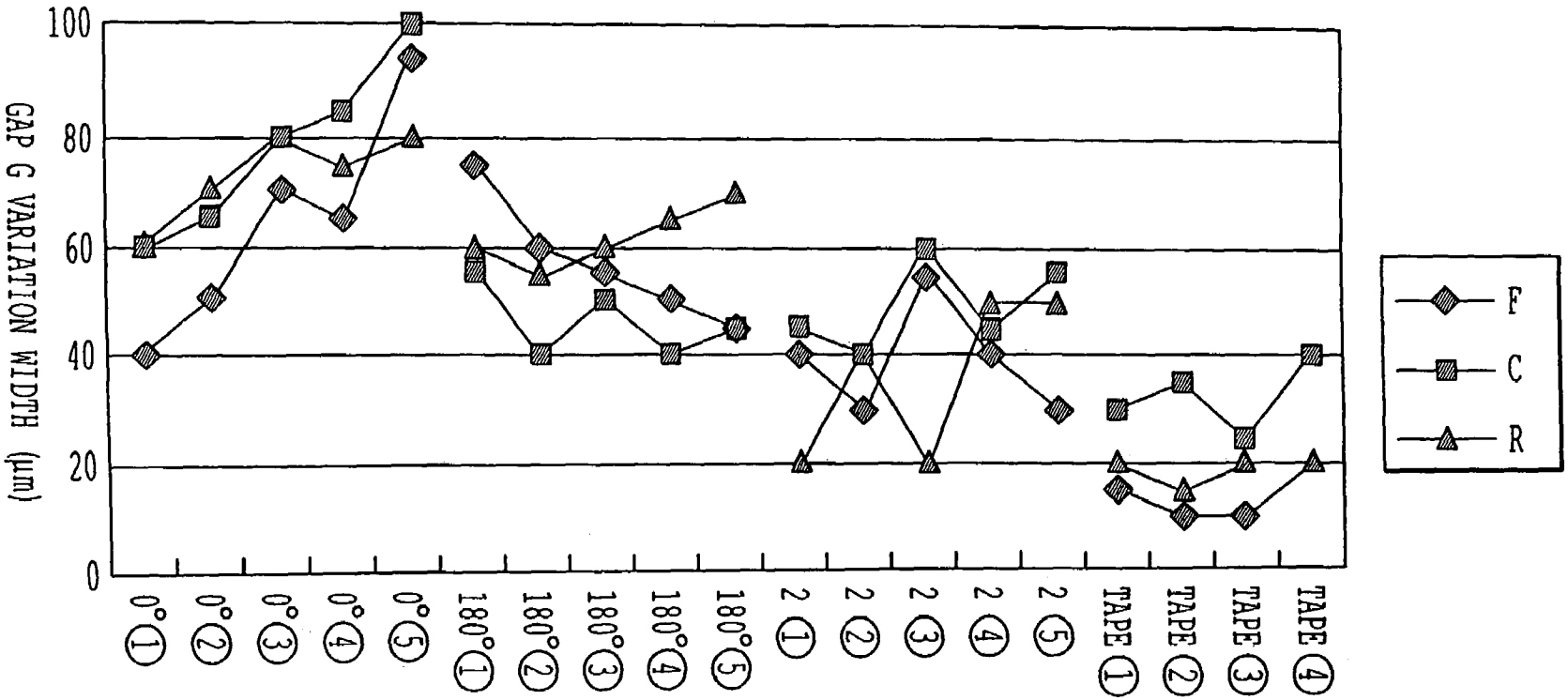
FIG. 15 is a plot showing the variation widths of gap formed between various rollers and an image carrier.

FIG. 14 plots the maximum and minimum values of each roller measured while FIG. 15 plots a variation width, i.e., a difference between the maximum and minimum values of the gap G. In FIGS. 14 and 15, "0°" and "180°" are respectively representative of the comparative example 1 and example 1 while "2" and "TAPE" are respectively representative of the example 2 and comparative example 2. As shown, five rollers of the comparative example 1 all contacted the drum 5 at the center portion, but none of the rollers based on the other conditions contacted the drum 5. The variation width of the gap G is as large as 40 μm to 100 μm in the comparative example 1, but decreases to 40 μm to 80 μm in the example 1 or to 20 μm to 60 μm in the example 2. As for the stability of the initial gap, the tapes of the comparative example 2 are most desirable because the variation width of the gap G is as small as 15 μm to 40 μm.

Even when 150,000 prints were continuously output, the tubes of the rollers based on the examples 1 and 2 and the drum 5, which contacted the tubes, were free from damage while the portions of the rollers, corresponding to the image range of the drum 5, were smeared little, implementing high image quality. As for the rollers of the comparative example 1, the tubes and drum 5 were free from damage when 100,000 prints were output, but toner, for example, deposited on the center portion while image density was irregular. As for the rollers of the comparative example 2, toner started to deposit on an adhesive layer forced out from the edges of the tape when about 10,000 prints were output; the masses of toner grew little by little and made, when about 50,000 prints were output, the gap excessively broad with the result that irregular density appeared in images due to abnormal discharge. Moreover, the tape and drum 5 both were scratched at many positions.

The results of the above experiments and tests indicate that the charging device with tubes is more durable than the charging device with a tape, that, in the case of tubes, shifting the tubes in phase is desirable, and that the charging device 30 with two tubes positioned at each end is smaller in variation width than the charging device 30 with a single tube positioned at each end.

The charging device 30 and drum 5 are constructed into a single process cartridge, as stated earlier. The charging device 30 and drum 5 whose lives are extending do not need frequent replacement and can be easily replaced together. If desired, the charging device 30 and drum 5 may be constructed into a process cartridge together with other members and means or may not necessarily be constructed integrally with each other.

It is to be noted that the angle by which the regulating members are shifted in phase from each other is not limited to 180° shown and described, but may be any other angle lying in a range suitable for charging. The two regulating members positioned at each end may, of course be replaced with three or more regulating members.

As stated above, the illustrative embodiment has various advantages, as enumerated below.

(1) Even when use is made of regulating members usually having a thickness deviation each, a gap with required accuracy can be formed between the charge roller 14 and the drum 5 at low cost.

(2) The regulating members at opposite ends of the charge roller 14, which are shifted in phase from each other by 180°, prevent the charge roller 14 from contacting the drum 5. This is also successful to form the above gap.

(3) The charge roller 5 can be provided with accurate configuration.

(4) The regulating members can be fitted on the charge roller 14 without resorting to an adhesive, facilitating low cost, easy production. In addition, the regulating members are lower in hardness than the charge roller 14 and therefore damage the drum 5 little. This extends the life of the drum 5.

(5) Not only the charging device but also the drum 5 are low cost.

(6) The charging device and drum 5 whose life are extending do not need frequency replacement and can be easily replaced even by the user of the printer together. In addition, a gap of adequate size can be formed between the charge roller 14 and the drum 5, insuring desirable charging and therefore desirable image formation.

Fourth Embodiment

A fourth embodiment of the present invention to be described hereinafter constitutes an improvement over the third embodiment. An elongate tube from which the tubes 63 are to be produced sometimes has a thickness deviation different from the pattern shown in FIG. 11, as determined by experiments. For example, a thermally shrinkable tube to be fitted by thermal shrinkage is provided with a tubular configuration on the production line and then stretched by a machine in the normal direction before shipment. Although the stretch allows the tube to thermally shrink in the event of fitting, it sometimes brings about a thickness deviation in the circumferential direction.

Figure 16:
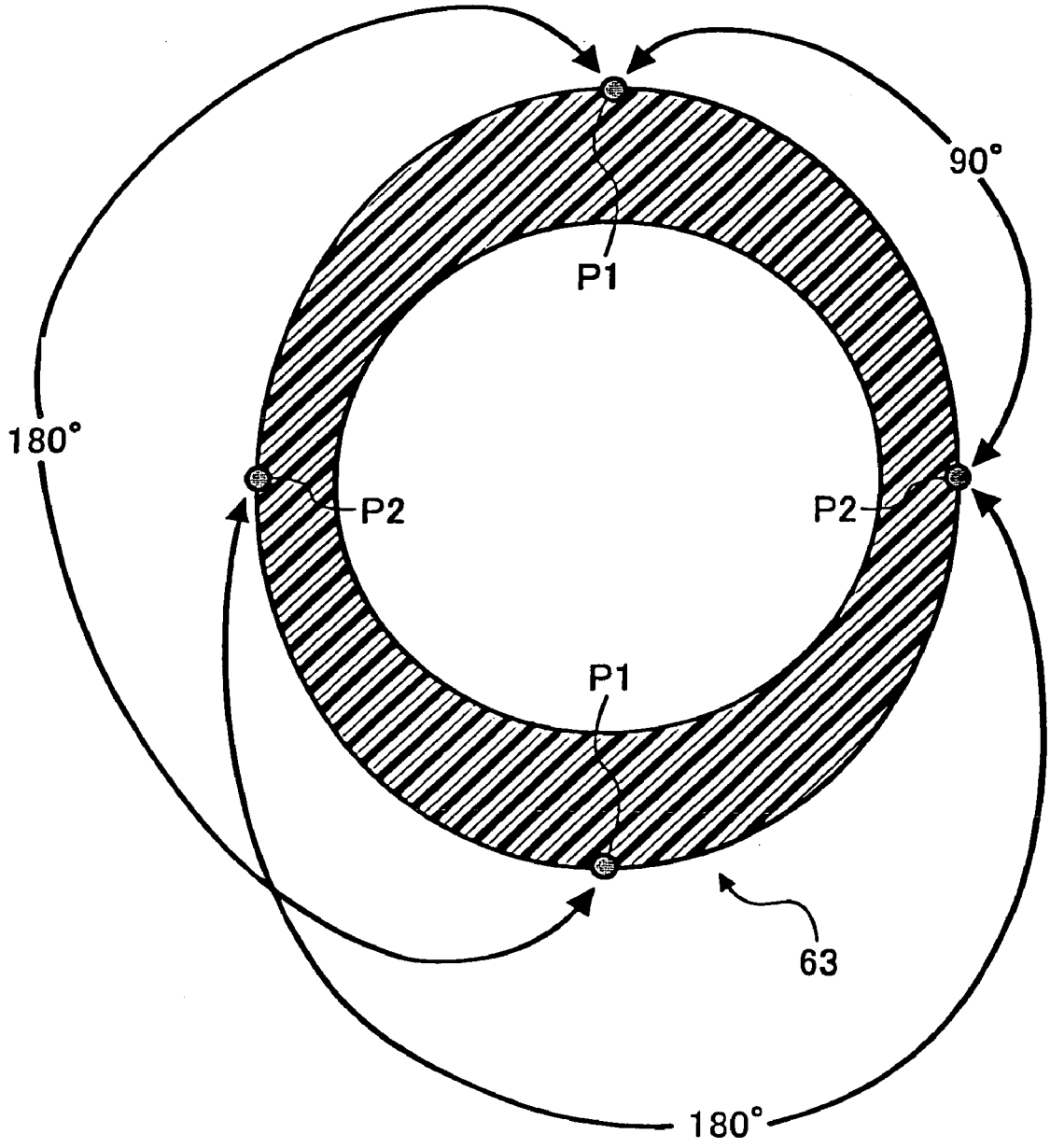
FIG. 16 is a section showing a tube including two thickness peaks and two thinness peaks in the circumferential direction.

More specifically, as shown in FIG. 16, when two rods are inserted into the molded tube and then moved away from each other to stretch the tube, two thickness peaks P1, shifted from each other by 180° in phase, appear. At the same time, two thinness peaks P2, shifted from the thickness peaks P1 by 90°, appear and are shifted from each other by 180°. If two tubes produced from such an elongate tube are fitted on the charge roller 14 such that they are shifted from each other by 180° in phase, then the thinness peaks P2 align with each other on the opposite ends of the charge roller 14, aggravating the decrease in gap G.

It is likely that even a roller other than the charge roller 14 is smeared due to the decrease in gap G if the tubes 63*a* and 63*b* are fitted on opposite ends of the roller. The smear would accumulate and bring about some trouble.

The illustrative embodiment is identical with the first embodiment shown in FIGS. 1 and 2 as to the general construction of the image forming apparatus and that of the drum unit. Let the following description concentrate on differences between the illustrative embodiment and the first embodiment.

Figure 17:
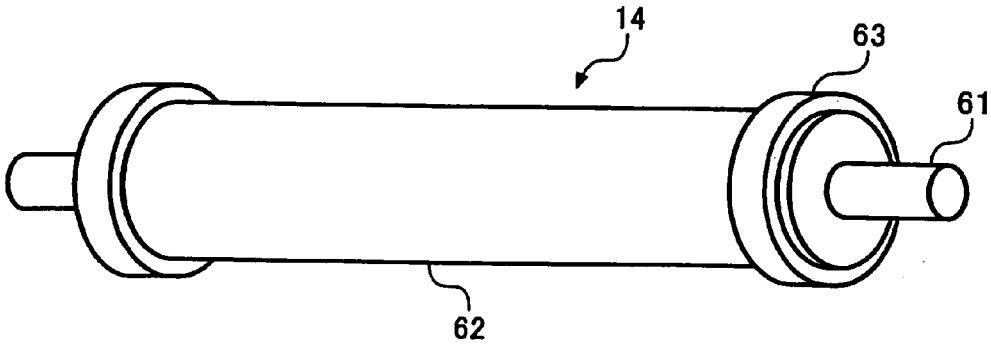
FIG. 17 is an isometric view showing a charge roller representative of a fourth embodiment of the present invention.

FIG. 17 shows a charge roller 14 included in the illustrative embodiment. As shown, the charge roller 14 is made up of a core 61 formed of iron, stainless steel or similar metal and a roller member 62 formed of ABS or similar resin and covering the core 61. Elastic annular members 63, corresponding to the gap forming members of the first and second embodiments, are fitted on opposite end portions of the charge roller 14, forming annular projections protruding from the circumference of the charge roller 14. The annular members 63 are produced by cutting an elongate, thermally shrinkable tube, not shown, at preselected length.

Figure 18:
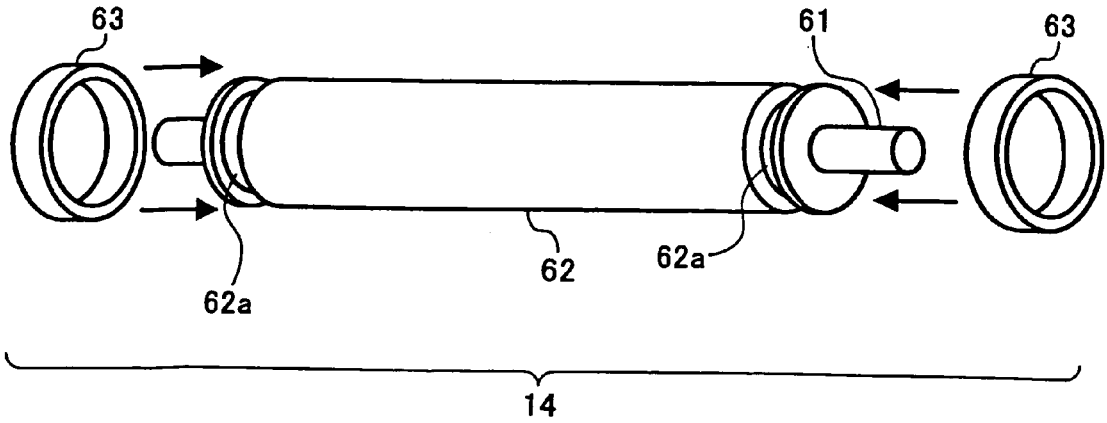
FIG. 18 is an exploded isometric view showing the charge roller of FIG. 17.

More specifically, as shown in FIG. 18 in an exploded view, annular grooves 62*a* are formed in opposite end portions of the roller member 62. The two tubes 63, each having an inside diameter larger than the outside diameter of the roller member 62, are coupled over the roller member 62, positioned on the annular grooves 62*a*, and then caused to shrink by heat. As a result, the tubes 63 are tightly fitted in the grooves 62*a* and prevented from being shifted in the axial direction of the roller member 62. Further, the tubes 63 are shifted little in the circumferential direction even when rotating in contact with the drum 5. If desired, an adhesive may be coated on the walls of the grooves 62*a* before heating in order to obviate dislocation in the circumferential direction more positively.

Generally, a thermally shrinkable tube has a thickness deviation in the circumferential direction; the deviation is about ±10% of designed thickness, as stated earlier. Such a deviation is apt to vary the gap G between the center portion of the charge roller 14 and the drum 5 and cause the former to contact the latter.

In light of the above, in the illustrative embodiment, the tubes 63 are fitted on the opposite end portions of the charge roller 14 in a unique way, as will be described hereinafter. The tubes 63 are positioned on the charge roller 14 such that the thickness peak of one tube 63 and the thinness peak of the other tube 63 exist at the same position in the circumferential direction. In this configuration, a decrease in gap G ascribable to the thinness peak of one tube and an increase in gap ascribable to the thickness peak of the other tube 63 buffer each other. This successfully prevents the gap G from increasing for thereby surely reducing smears otherwise accumulating on the roller member 62.

Figure 19B:
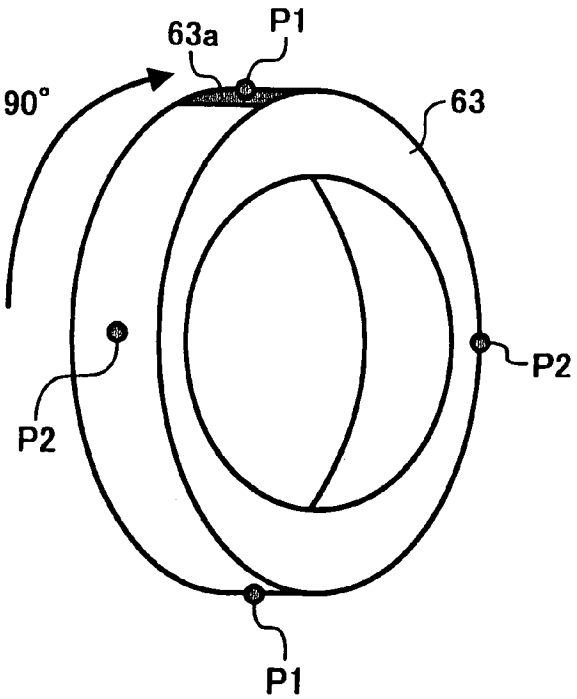
FIGS. 19A and 19B are isometric views showing two tubes fitted on the charge roller of FIG. 17.
Figure 19A:
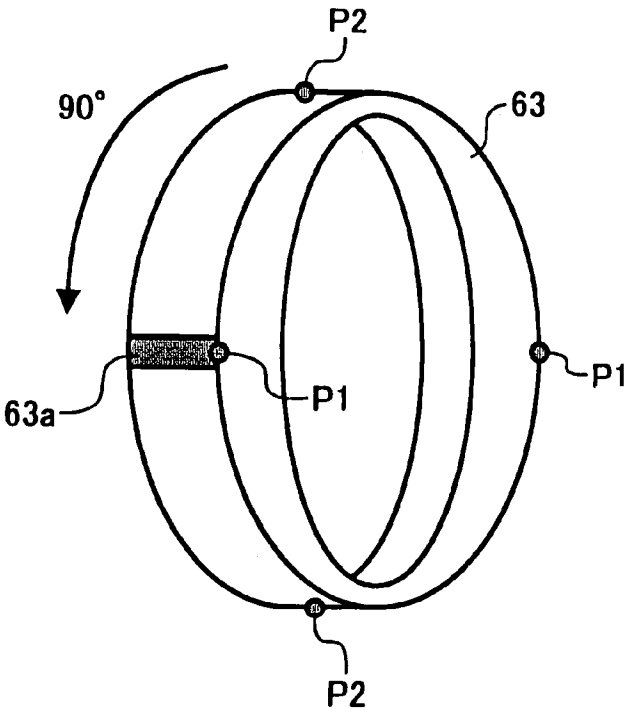
Figure 20:
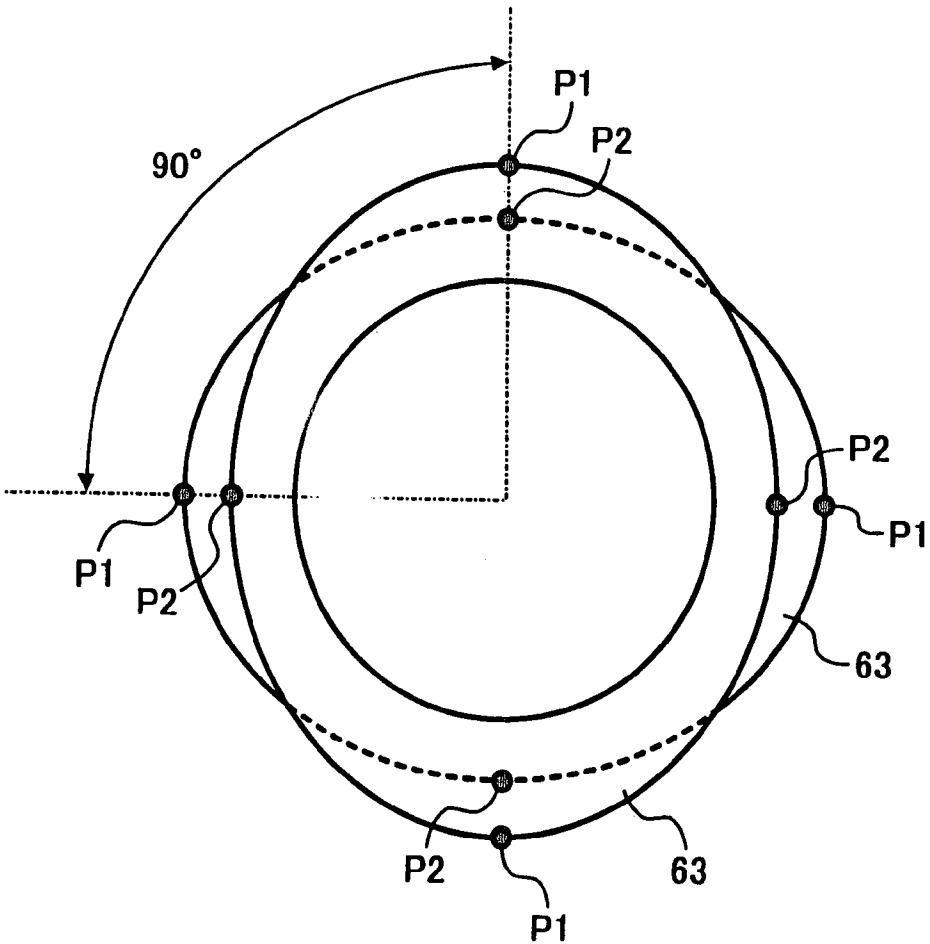
FIG. 20 is a view showing the two tubes as seen from one side.
Figure 21:
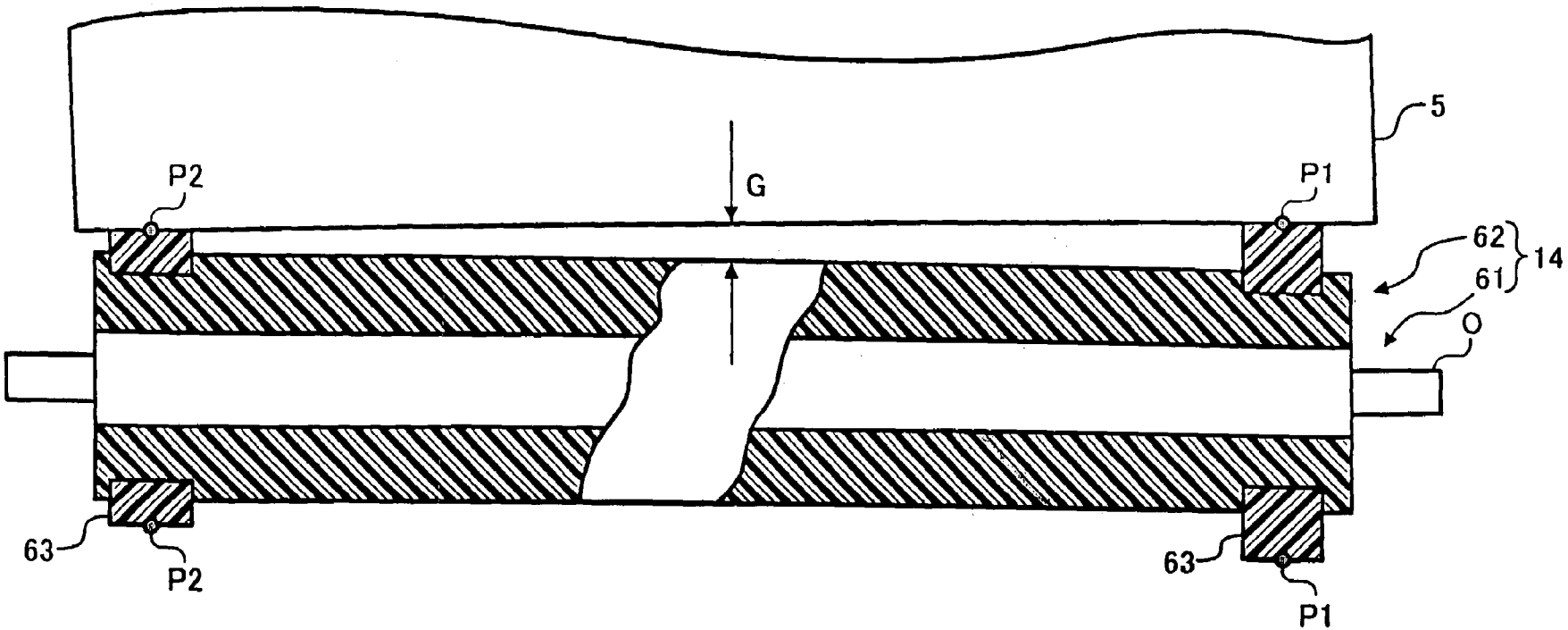
FIG. 21 is a vertical section showing the charge roller and a photoconductive drum in a condition wherein the thinness peak of one of the two tubes contacts the drum.
Figure 22:
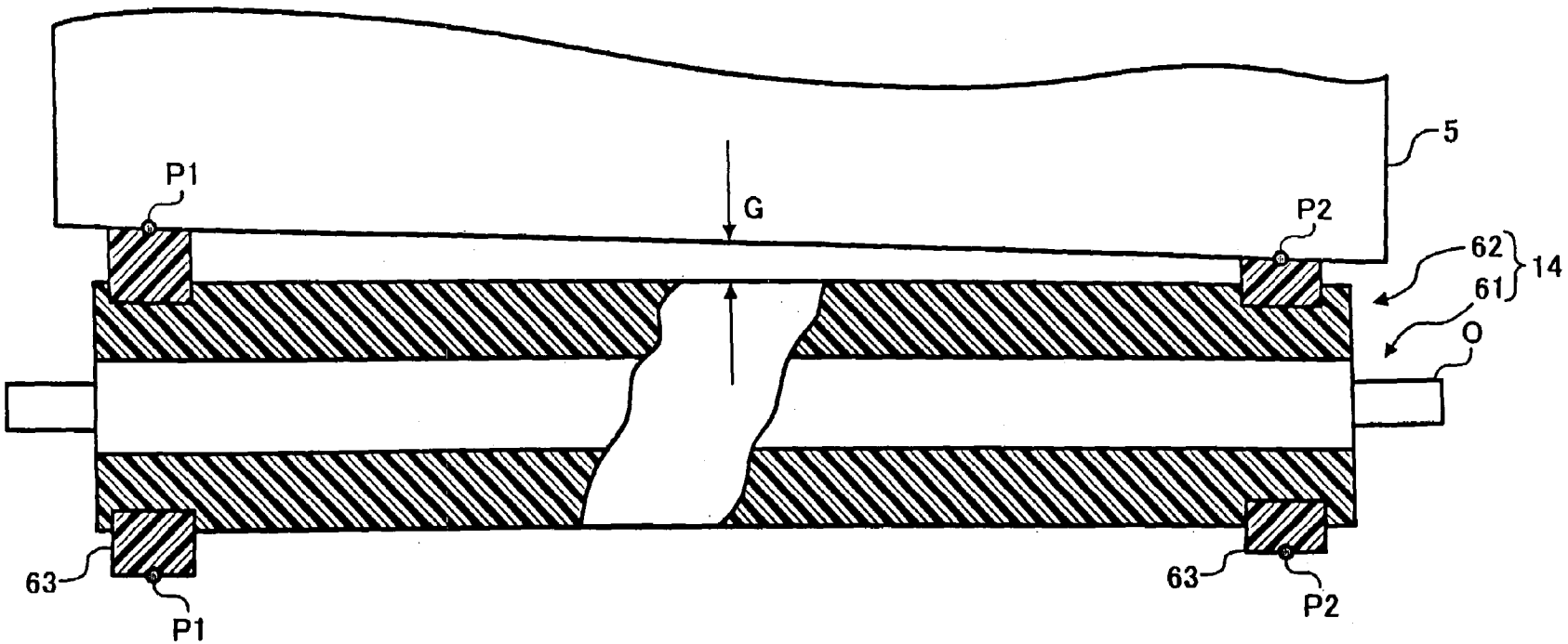
FIG. 22 is a view similar to FIG. 21, showing a condition wherein the thinness peak of the other tube contacts the drum.

The two tubes 63, like the tube 63 shown in FIG. 16, each have a thickness deviation that causes the two thickness peaks P1 and two thinness peaks P2 to appear. FIGS. 19A and 19B respectively show the two tubes 63 in positions fitted on the charge roller 14. As shown, the thickness peaks P1 of the tubes 63 are shifted from each other by 90°. In this condition, as shown in FIG. 20, the thickness peaks P1 of one tube 63 exist at the same positions as the thinness peaks P2 of the other tube 63 in the circumferential direction of the charge roller 14. Therefore, as shown in FIGS. 21 and 22, when the thinness peaks P2 of one tube 63 contact the drum 5, the thickness peaks P1 of the other roller also contact the drum 5. This successfully controls the decrease in gap G when the thinness peaks P2 contact the drum 5.

As shown in FIGS. 19A and 19B, marks 63*a* are positioned on the circumferential surface of each tube 63 at positions corresponding to the thickness peaks P1. The marks 63*a* are significant in that when either one of the tubes 63 should be replaced for some reason, a new tube 63 can be accurately mounted to the charge roller 14 by using the marks 63*a* of the other tube 63 still usable as a reference.

The marks 63*a* may be formed by use of ink or similar colored material. In this case, the colored material should preferably be infiltrative into the circumferential surfaces of the tubes 63 as far as possible, so that the marks 63*a* can be maintained visible over a long time despite the wear of the tubes 63. If desired, the marks 63*a* may be positioned on the side surface of each tube 63, in which case the marks 63*a* will not disappear despite the wear of the circumferential surface of the tube 63.

An elongate thermally shrinkable tube from which the tubes 63 are produced may be folded up in the form of a roll and stored, in which case the resulting folds will play the role of the marks 63*a*. Alternatively, fine grooves may be formed in the circumferential surfaces of the tubes 63 by laser machining. If desired, the marks 63*a* may be located at positions corresponding to the thinness peaks P2 instead of the thickness peaks P1. Further, when a plurality of thickness peaks P1 and a plurality of thinness peaks P2 exist, two different kinds of marks 63*a*, capable of distinguishing the peaks P1 and P2, may be used, so that a thickness variation pattern can be easily seen. Moreover, if the tubes 63 each have a particular thickness variation pattern, then one thickness peak P1 of one tube 63 and one thinness peak P2 of the other tube 63 should only be located at the same position in the circumferential direction of the roller.

While the tubes 63 fitted on the charge roller 14 may be machined to sufficiently reduce the width of thickness variation and therefore to prevent the roller member 62 from contacting the drum 5, this scheme is not practical because machining is time- and labor-consuming. While use may be made of thin tubes with a minimum of thickness variation width, such tubes are undesirable from the strength and durability standpoint.

Figure 23:
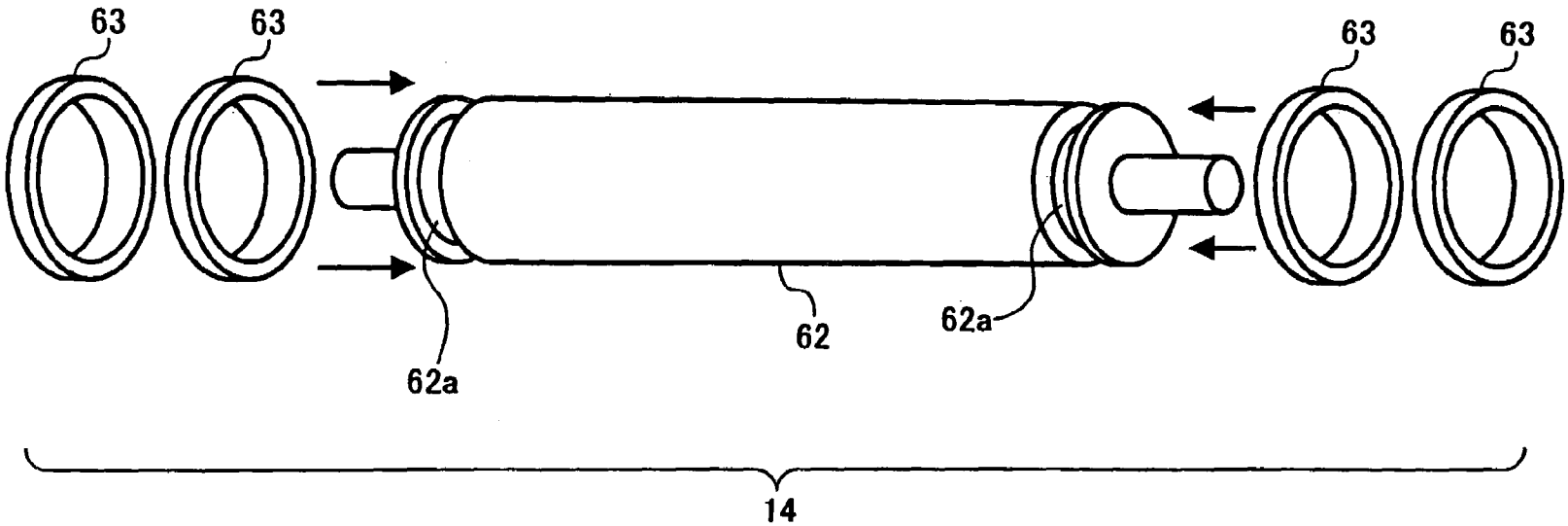
FIG. 23 is an exploded isometric view showing a modification of the charge roller of the fourth embodiment.

FIG. 23 shows a modification of the illustrative embodiment. As shown, a plurality (two in the illustrative embodiment) tubes 63 are fitted in each of the annular grooves 62*a* although each of them may be fitted in a respective groove. The tubes 63 each have a thickness deviation corresponding in pattern to the thickness variation shown in FIG. 16.

At each end of the charge roller 14, the thickness peaks P1 of at least one tube 63 and the thinness peaks P2 of the other tube 63 exist at the same positions as each other in the circumferential direction. Therefore, the thickness deviation of at least one tube 63 in the circumferential direction and that of the other tube buffer each other at each end of the charge roller 14. This controls the variation of the gap G ascribable to the thickness deviation for thereby surely preventing smears from accumulating on the charge roller 14.

Figure 24:
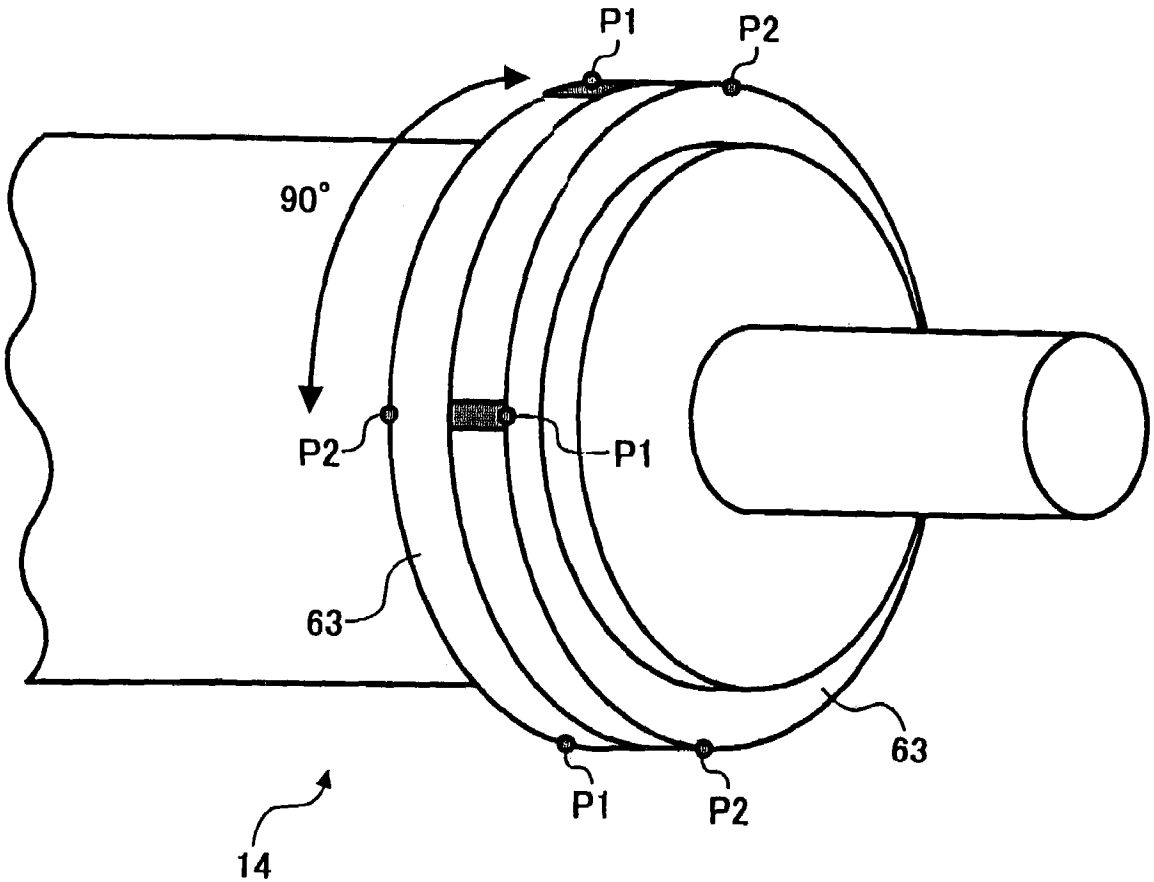
FIG. 24 is an exploded isometric view showing one end portion of a modification of the charge roller.

FIG. 24 shows one end portion of the charge roller 14 on which two tubes 63 are fitted. As shown, the marks 63*a* indicative of the thickness peaks P1 are provided on the circumferential surface of each tube 63. The tubes 63 are shifted in phase from each other by 90° such that the thickness peaks P1 of one tube 63 and the thinness peaks P2 of the other tube 63 exist at the same positions as each other in the circumferential direction of the charge roller 14. Two tubes 63 are fitted on the other end portion of the charge roller 14 as well although not shown specifically.

Figure 25:
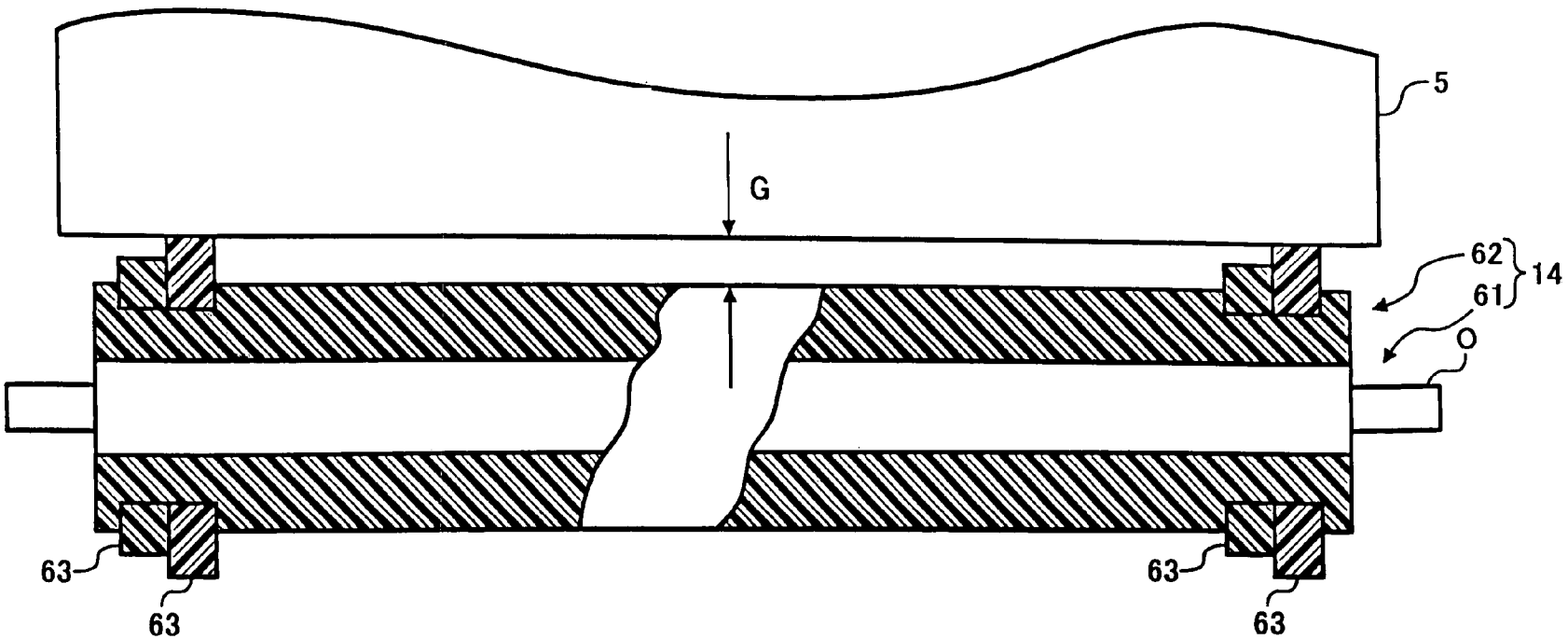
FIG. 25 is a vertical section showing the charge roller and drum in a condition wherein the thinness peak of one of a plurality of tubes fitted on each end portion of the charge roller contacts the drum.
Figure 26:
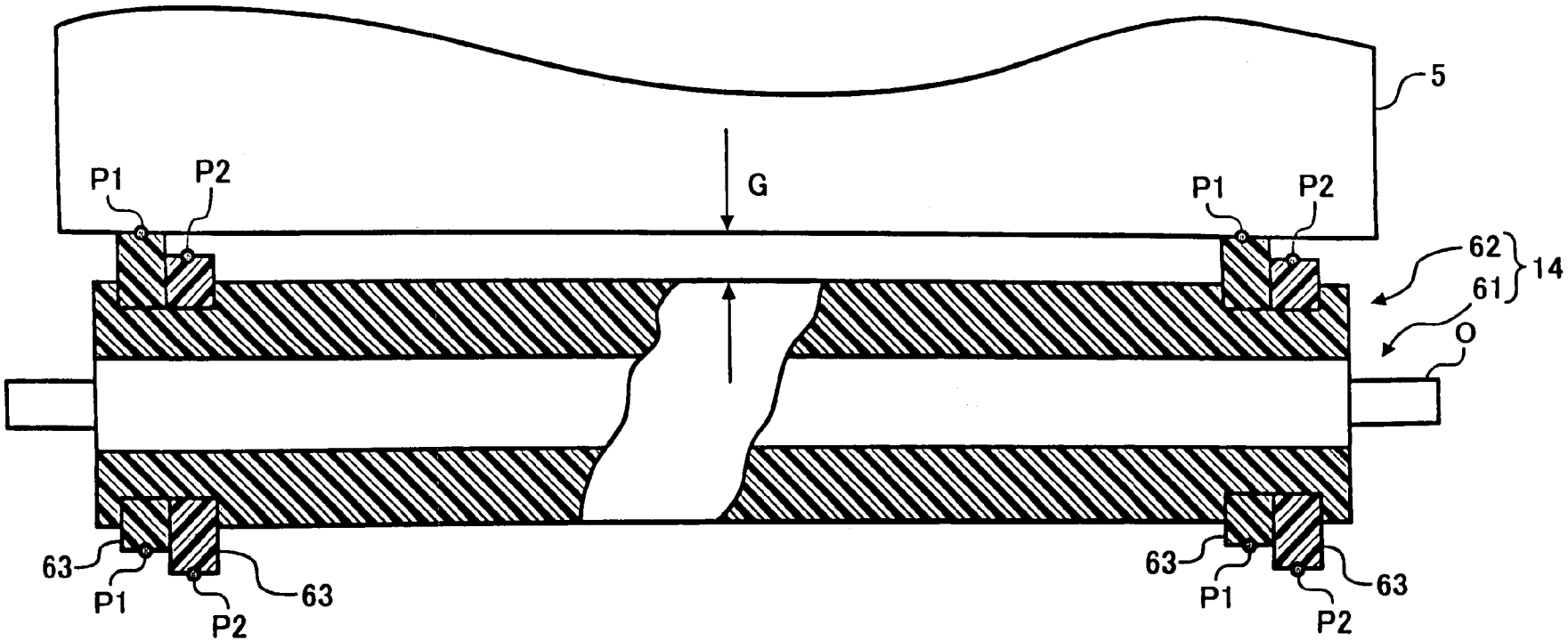
FIG. 26 is a vertical section similar to FIG. 25, showing a condition wherein the thinness peak of the other tube contacts the drum.

In the above configuration, as shown in FIGS. 25 and 26, the thinness peak P2 of one tube and the thickness peak P1 of the other tube 36 face the drum 5 at each end portion of the charge roller 14; the thickness peak P1 contacts the drum 5. This prevents the thinness peaks P2 of all of the tubes 63 from contacting the drum 5 at the same time and therefore reduces the variation of the gap G without regard to the thickness deviation pattern in the circumferential direction, thereby surely preventing smears from accumulating on the charge roller 14.

Figure 27:
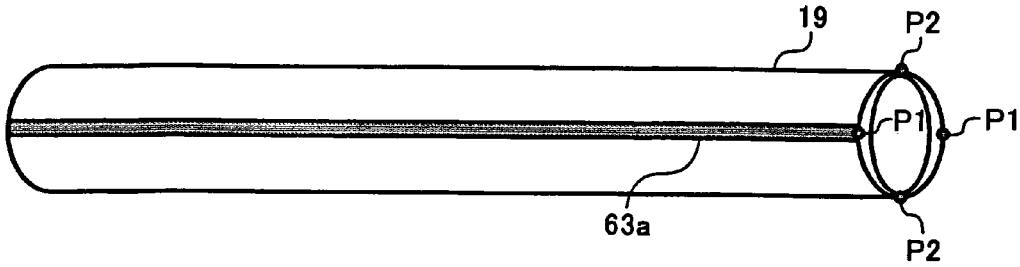
FIG. 27 is an isometric view showing an elongate, thermally shrinkable tube.
Figure 28:
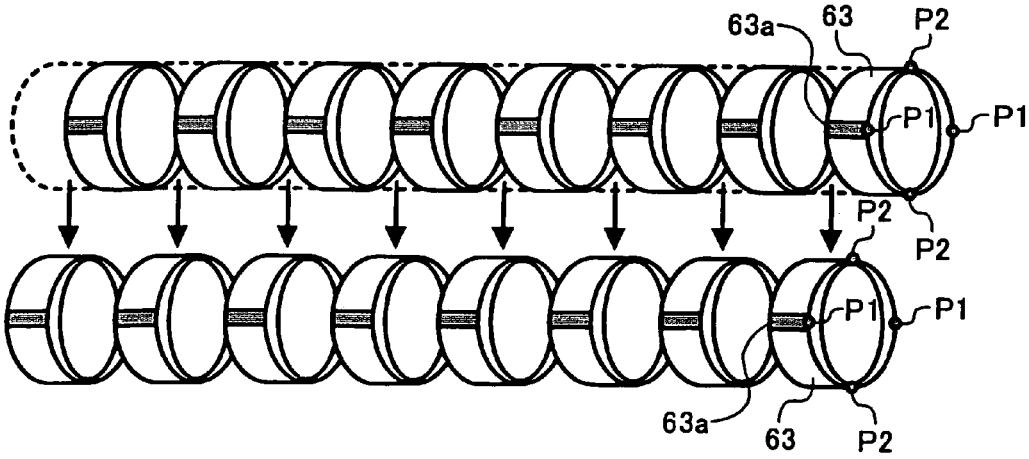
FIG. 28 is an isometric view showing a plurality of tubes produced by equally cutting the elongate tube in the lengthwise direction.

A specific method of producing the charge roller 14 of the illustrative embodiment will be described hereinafter. FIG. 27 shows an elongate thermally shrinkable tube 19 from which the tubes 63 are to be produced. The elongate tube 19 has the thickness deviation pattern described with reference to FIG. 16 and causing the two thickness peaks P1 and two thinness peaks P2 to appear. The elongate tube 19 is cut at preselected length to produce the tubes 63 to be fitted in the grooves 62*a*.

As shown in FIG. 27, before the elongate tube 19 is cut, the mark 63*a* (only one is visible) indicative of the thickness peaks P1 are formed on the tube 19 in the form of straight lines extending in the lengthwise direction of the tube 19. Subsequently, the tube 19 is cut to produce a plurality of tubes 63 on each of which the marks 63*a* exist. A person can therefore fit the tubes 63 on the charge roller 14 while shifting at least two of them 63 by 90° in phase. The charge roller 14 of the illustrative embodiment is therefore easy to produce.

The illustrative embodiment, implemented as a tandem color printer, may be implemented as a full-color image forming apparatus, if desired. Further, the illustrative embodiment is applicable even to an image forming apparatus of the type using a developing liquid, an image forming apparatus of the type forming an image with a system different from the electrophotographic system or an image forming apparatus of the type of the type forming only a monocolor image. In addition, the illustrative embodiment may be implemented as a charging device including at least the charge roller 14 and bearings supporting it or only as a charge roller 14.

As stated above, the illustrative embodiment surely controls the accumulation of smears on the charge roller 14 without regard to the thickness deviation pattern of each tube 63 in the circumferential direction and facilitates the production of the charge roller 14.

Various modifications will become possible for those skilled in the art after receiving the teachings of the present disclosure without departing from the scope thereof.

What is claimed is:

1. A roller comprising:

annular members fitted on opposite end portions thereof, said annular members each having a thickness deviation in a circumferential direction in which a thickness peak and a thinness peak each appear at least once, and said annular members are positioned such that the thickness peak of one annular member and the thinness peak of the other annular member are located at a same position in the circumferential direction of said roller.

2. The roller as claimed in claim 1, wherein said annular members at the opposite end portions or at least one and another of a plurality of annular members positioned at each end portion are positioned such that the thickness peaks are shifted by 90°.

3. The roller as claimed in claim 1, wherein a mark indicative of a particular position of the thickness deviation is positioned on each of said annular members.

4. A roller comprising:

annular members fitted on opposite end portions thereof, a plurality of annular members, each having a thickness deviation in a circumferential direction in which a thickness peak and a thinness peak each appear at least once, are fitted on each of opposite end portions of said roller, and said annular members at each end portion are positioned such that the thickness peak of at least one annular member and the thinness peak of the other annular member are located at a same position in the circumferential direction of said roller.

5. The roller as claimed in claim 1, wherein said annular members at the opposite end portions or at least one and another of a plurality of annular members positioned at each end portion are positioned such that the thickness peaks are shifted by 90°.

6. The roller as claimed in claim 1, wherein a mark indicative of a particular position of the thickness deviation is positioned on each of said annular members.

7. An image forming apparatus comprising:

an image carrier configured to carry a latent image thereon;

a charge roller configured to charge said image carrier;

latent image forming means for forming the latent image on said image carrier charged by said charged by said charge roller; and developing means for developing the latent image, wherein said charge roller comprises annular members fitted on opposite end portions thereof, said annular members each having a thickness deviation in a circumferential direction in which a thickness peak and a thinness peak each appear at least once, and said annular members are positioned such that the thickness peak of one annular member and the thinness peak of the other annular member are located at a same position in the circumferential direction of said roller.

8. An image forming apparatus comprising:

an image carrier configured to carry a latent image thereon;

a charge roller configured to charge said image carrier;

latent image forming means for forming the latent image on said image carrier charged by said charged by said charge roller; and developing means for developing the latent image, wherein said charge roller comprises annular members fitted on opposite end portions thereof, a plurality of annular members, each having a thickness deviation in a circumferential direction in which a thickness peak and a thinness peak each appear at least once, are fitted on each of opposite end portions of said roller, and said annular members at each end portion are positioned such that the thickness peak of at least one annular member and the thinness peak of the other annular member are located at a same position in the circumferential direction of said roller.

* * * * *

UNITED STATES PATENT AND TRADEMARK OFFICE

CERTIFICATE OF CORRECTION

PATENT NO. : 7,113,727 B2
APPLICATION NO. : 11/252808
DATED : September 26, 2006
INVENTOR(S) : Kosuge et al.

It is certified that error appears in the above-identified patent and that said Letters Patent is hereby corrected as shown below:

On the title page, Item (75), the 2nd and 3rd Inventors' names should be deleted. Item (75) should read:

-- (75) Inventor: Akio Kosuge, Kanagawa (JP) --

Signed and Sealed this

Nineteenth Day of December, 2006

JON W. DUDAS
*Director of the United States Patent and Trademark Office*